US011315478B2

(12) United States Patent
Kim et al.

(10) Patent No.: US 11,315,478 B2
(45) Date of Patent: Apr. 26, 2022

(54) DISPLAY DEVICE

(71) Applicant: LG Display Co., Ltd., Seoul (KR)

(72) Inventors: Jun Su Kim, Paju-si (KR); Jae Kwon Chae, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/121,342

(22) Filed: Dec. 14, 2020

(65) Prior Publication Data

US 2021/0201757 A1 Jul. 1, 2021

(30) Foreign Application Priority Data

Dec. 26, 2019 (KR) ..... 10-2019-0175531

(51) Int. Cl.
*G09G 3/20* (2006.01)
*G09G 3/3225* (2016.01)
(Continued)

(52) U.S. Cl.
CPC ..... *G09G 3/2096* (2013.01); *G09G 3/006* (2013.01); *G09G 3/20* (2013.01); *G09G 3/2092* (2013.01);
(Continued)

(58) Field of Classification Search
CPC ..... G09G 3/006; G09G 3/20; G09G 3/2018; G09G 3/2092; G09G 3/2096; G09G 3/30; G09G 3/32; G09G 3/3208; G09G 3/3225; G09G 3/36; G09G 2310/0278; G09G 2310/06; G09G 2310/08; G09G 2330/06; G09G 2370/08; G09G 2370/16;
(Continued)

(56) References Cited

U.S. PATENT DOCUMENTS 8,330,699 B2 * 12/2012 Hong ..... G09G 3/3688 345/99
8,493,373 B2 * 7/2013 Jeon ..... G09G 3/20 345/204
(Continued)

FOREIGN PATENT DOCUMENTS

KR 10-2017-0123074 A 11/2017

OTHER PUBLICATIONS

Intellectual Property India, Office Action, IN Patent Application No. 202014055165, dated Dec. 28, 2021, five pages.

*Primary Examiner* — Jason M Mandeville
(74) *Attorney, Agent, or Firm* — Fenwick & West LLP

(57) ABSTRACT

A display device according to an embodiment of the present disclosure includes a display panel configured to display an image using a plurality of pixels, a timing controller configured to generate an embedded clock point-to-point interface (EPI) data signal according to an EPI protocol, a display panel driver configured to write pixel data of an input image onto the plurality of pixels based on the EPI data signal, a wireless signal detection unit configured to detect an electromagnetic wave signal surrounding the display device and convert the detected electromagnetic wave signal into an electric signal, and a detection signal output unit configured to compare the electric signal with a reference signal and output a detection signal according to a comparison result, wherein the timing controller converts a preset signal characteristic of the EPI data signal according to the detection signal and outputs the EPI data signal.

20 Claims, 18 Drawing Sheets

(51) Int. Cl.

| | |
|---|---|
| ***H01Q 1/38*** | (2006.01) |
| ***H01Q 1/22*** | (2006.01) |
| ***H01Q 1/36*** | (2006.01) |
| ***H01Q 1/44*** | (2006.01) |
| ***H01Q 9/04*** | (2006.01) |
| ***G09G 3/00*** | (2006.01) |

(52) U.S. Cl.
CPC ..... *G09G 3/3225* (2013.01); *H01Q 1/2258* (2013.01); *H01Q 1/36* (2013.01); *H01Q 1/38* (2013.01); *H01Q 1/44* (2013.01); *H01Q 9/0421* (2013.01); *G09G 2310/0278* (2013.01); *G09G 2310/06* (2013.01); *G09G 2310/08* (2013.01); *G09G 2330/06* (2013.01); *G09G 2370/08* (2013.01)

(58) Field of Classification Search
CPC ..... H01Q 1/2258; H01Q 1/36; H01Q 1/38; H01Q 1/44; H01Q 9/0421
USPC ..... 345/204, 208, 214, 76, 87
See application file for complete search history.

(56) References Cited

U.S. PATENT DOCUMENTS

| | | | | |
|---|---|---|---|---|
| 8,884,934 | B2 * | 11/2014 | Jeon | G09G 3/20 345/204 |
| 9,570,039 | B2 * | 2/2017 | Shie | G09G 5/008 |
| 10,643,574 | B2 * | 5/2020 | Tzeng | G09G 5/008 |
| 10,747,360 | B2 * | 8/2020 | Park | G06F 3/0416 |
| 2010/0225637 | A1 * | 9/2010 | Jeon | G09G 3/20 345/213 |
| 2016/0378265 | A1 * | 12/2016 | Katsurahira | G06F 3/0383 345/174 |
| 2018/0122294 | A1 | 5/2018 | Do et al. | |
| 2019/0237041 | A1 * | 8/2019 | Tzeng | G09G 5/005 |
| 2019/0339808 | A1 * | 11/2019 | Park | G06F 3/0412 |

* cited by examiner

DISPLAY DEVICE

CROSS-REFERENCE TO RELATED APPLICATION

The present disclosure claims priority under 35 U.S.C. § 119 to Republic of Korea Patent Application No. 10-2019-0175531 filed on Dec. 26, 2019, which is incorporated herein by reference in its entirety.

BACKGROUND

1. Field of Technology

Embodiments relate to a display device capable of converting an embedded clock point-to-point interface (EPI) signal adaptively to a usage environment.

2. Discussion of Related Art

With the advancement of the information age, a demand for display devices for displaying an image has been increased in various forms. Recently, various kinds of display devices such as liquid crystal display (LCD) devices, plasma display panel (PDP) devices, and organic light-emitting diode (OLED) display devices have been used.

The display device includes a display panel in which data lines and gate lines are formed and which includes subpixels defined at points at which the data lines and the gate lines intersect each other. In addition, the display device includes a data driver which supplies data voltages to the data lines, a gate driver which supplies scan signals to the gate lines, and a timing controller which controls the data driver and the gate driver.

In order to control the data driver and the gate driver, the timing controller generates an internal data enable signal based on a data enable signal input from the outside and generates and outputs control signals for controlling the data driver and the gate driver based on the generated internal data enable signal. The timing controller transfers an embedded clock point-to-point interface (EPI) data signal to the data driver, and the data driver outputs an image by writing data onto a plurality of pixels according to the EPI data signal.

However, according to a usage environment of the display device, an error occurs in the output of the EPI data signal, which causes screen defects when an image is output. For example, when the display device is exposed to surrounding electromagnetic wave signals, a lock fail occurs. When the lock fail occurs, source drive integrated circuits (ICs) restart a process for fixing a phase and a frequency of an internal clock, and in this case, screen defects occur. Therefore, there is a need for technique for solving such a problem.

SUMMARY

The present disclosure is directed to providing a display device capable of detecting an electromagnetic wave signal, which may cause screen defects of the display device, in advance and capable of outputting an embedded clock point-to-point interface (EPI) data signal which is robust against the detected electromagnetic wave signal.

The object of the embodiments is not limited to the aforementioned and includes objects or effects that may be recognized from technical solutions or embodiments described hereinafter.

According to an aspect of the present disclosure, there is provided a display device including a display panel configured to display an image using a plurality of pixels, a timing controller configured to output an EPI data signal according to an EPI protocol, a display panel driver configured to write pixel data of an input image onto the plurality of pixels based on the EPI data signal, a wireless signal detection unit configured to detect a surrounding electromagnetic wave signal and convert the detected electromagnetic wave signal into an electric signal, and a detection signal output unit configured to compare the electric signal with a preset reference signal and output a detection signal according to a comparison result, wherein the timing controller converts a preset signal characteristic of the EPI data signal according to the output of the detection signal and outputs the EPI data signal.

When a voltage magnitude of a first level is detected from the detection signal, the timing controller may raise a voltage identification (VID) value of the EPI data signal and may output the EPI data signal.

When a voltage magnitude of a first level is detected from the detection signal, the timing controller may shift a frequency band of the EPI data signal to a frequency band adjacent to the frequency band of the EPI data signal among a plurality of preset frequency bands and may output the EPI data signal.

The wireless signal detection unit may include an antenna unit configured to detect the electromagnetic wave signal and convert the electromagnetic wave signal into an alternating current (AC) electric signal to output the AC electric signal, a voltage converting unit (ADC) provided with a converting circuit formed according to a voltage range of the AC electric signal output by the antenna unit and configured to amplify and rectify the AC electric signal to convert the AC electric signal into a direct current (DC) electric signal using the converting circuit, and an impedance matching unit configured to reduce reflection due to a difference in impedance between the antenna unit and the voltage converting unit (ADC) through using an impedance matching circuit.

The antenna unit may include at least one of a spiral antenna, a meander antenna, and a mechanical structure antenna using a structure constituting the display device.

The mechanical structure antenna may be electrically connected to a connection terminal of a printed circuit board on which the impedance matching circuit is printed, and the connection terminal may be disposed to be spaced apart from a ground terminal of the impedance matching circuit.

The impedance matching unit may be electrically connected to the antenna unit through one or more connection terminals, and the impedance matching unit may include one or more impedance matching circuits so as to correspond to the number of the connection terminals.

The converting circuit may include at least one of a first conversion circuit configured to amplify the AC electric signal, a second conversion circuit configured to rectify the AC electric signal, and a third conversion circuit configured to amplify and rectify the AC electric signal according to an output condition of the antenna unit.

In the case that the antenna unit is designed to output the AC electric signal in a range that is less than a first voltage value, in the converting circuit, the first conversion circuit and the third conversion circuit may be sequentially connected, the antenna unit may be connected to one end of the first conversion circuit, and the detection signal output unit may be connected to one end of the third conversion circuit.

In the case that the antenna unit is designed to output the AC electric signal in a range that is greater than or equal to the first voltage value, in the converting circuit, one end of the third conversion circuit may be connected to the antenna unit, and the other end thereof may be connected to the detection signal output unit.

In the case that the antenna unit is designed to output the AC electric signal in a range greater than or equal to a second voltage value that is less than the first voltage value, the converting circuit may include a first converting circuit in which the first conversion circuit and the second conversion circuit are sequentially connected, a second converting circuit including the third conversion circuit, and a switching element disposed between the first converting circuit and the second converting circuit and configured to control any one of outputs of the first converting circuit and the second converting circuit to be output.

The first conversion circuit may include an operational amplifier element or a bipolar junction transistor.

The detection signal output unit may include a comparison unit configured to compare the DC electric signal with the reference signal using a comparator element and output a comparison voltage, and a switching unit configured to control a voltage output according to the comparison voltage to generate the detection signal.

The reference signal may be determined by a plurality of resistor elements connected to one end of the comparator element in the comparison unit.

According to an aspect of the present disclosure, there is provided a display device driving method using a display device according to an embodiment of the present disclosure, the display device driving method including detecting a surrounding electromagnetic wave signal, converting the detected electromagnetic wave signal into an electric signal, comparing the electric signal with a preset reference signal, outputting a detection signal according to a comparison result, outputting an EPI data signal according to an EPI protocol, wherein a preset signal characteristic of the EPI data signal is converted according to the outputting of the detection signal to output the EPI data signal, and writing pixel data of an input image onto a plurality of pixels based on the EPI data signal and displaying an image using the plurality of pixels.

DETAILED DESCRIPTION

While the present disclosure is open to various modifications and alternative embodiments, specific embodiments thereof will be described and shown by way of example in the accompanying drawings. However, it should be understood that there is no intention to limit the present disclosure to the particular embodiments disclosed, and, on the contrary, the present disclosure is to cover all modifications, equivalents, and alternatives falling within the spirit and scope of the present disclosure.

It should be understood that, although the terms including ordinal numbers such as first, second, and the like may be used herein to describe various elements, the elements are not limited by the terms. The terms are used only for the purpose of distinguishing one element from another. For example, without departing from the scope of the present disclosure, a second element could be termed a first element, and similarly a first element could be also termed a second element. The term "and/or" includes any one or all combinations of a plurality of associated listed items.

In the case that one component is mentioned as being "connected" or "linked" to another component, it may be connected or linked to the corresponding component directly or other components may be present therebetween. On the other hand, in the case that one component is mentioned as being "directly connected" or "directly linked" to another component, it should be understood that other components are not present therebetween.

It is to be understood that terms used herein are for the purpose of the description of particular embodiments and not for limitation. A singular expression includes a plural expression unless the context clearly indicates otherwise. It will be further understood that the terms "comprises" and/or "comprising," when used in this specification, specify the presence of stated features, integers, steps, operations, elements, components, and/or groups thereof but do not preclude the presence or addition of one or more other features, integers, steps, operations, elements, components, and/or groups thereof.

Unless defined otherwise, all the terms (including technical and scientific terms) used herein have the same meaning as commonly understood by one of ordinary skill in the art to which the present disclosure belongs. It will be further understood that the terms, such as those defined in commonly used dictionaries, should be interpreted as having meanings that are consistent with their meanings in the context of the relevant art and should not be interpreted in an idealized or overly formal sense unless expressly defined otherwise herein.

Hereinafter, embodiments will be described in detail with reference to the accompanying drawings, and the same or corresponding elements will be given the same reference numbers regardless of drawing symbols, and redundant descriptions will be omitted.

Figure 1:
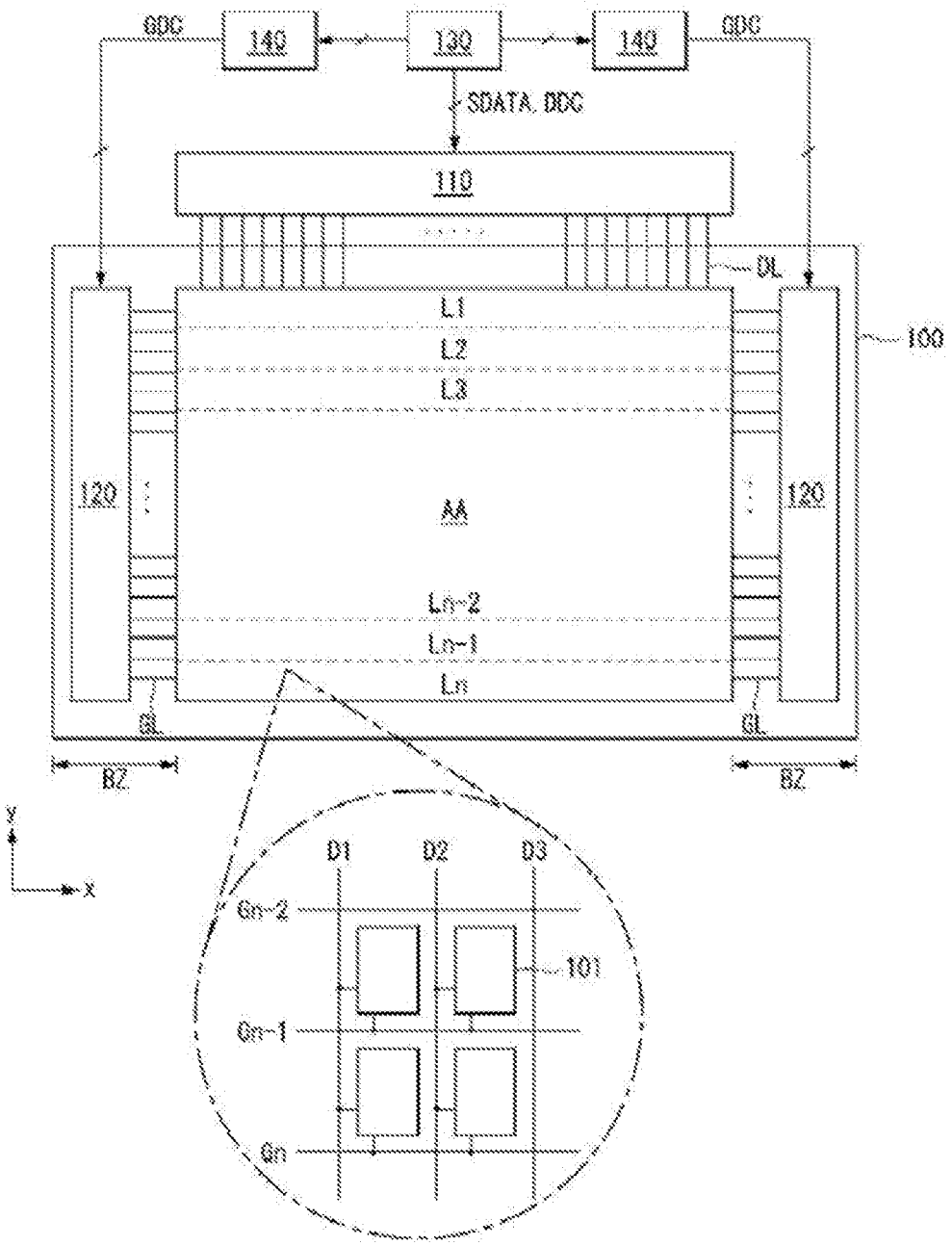
FIG. 1 is a schematic diagram illustrating a display device according to an embodiment of the present disclosure.

FIG. 1 is a schematic diagram illustrating a display device according to an embodiment of the present disclosure.

Figure 2:
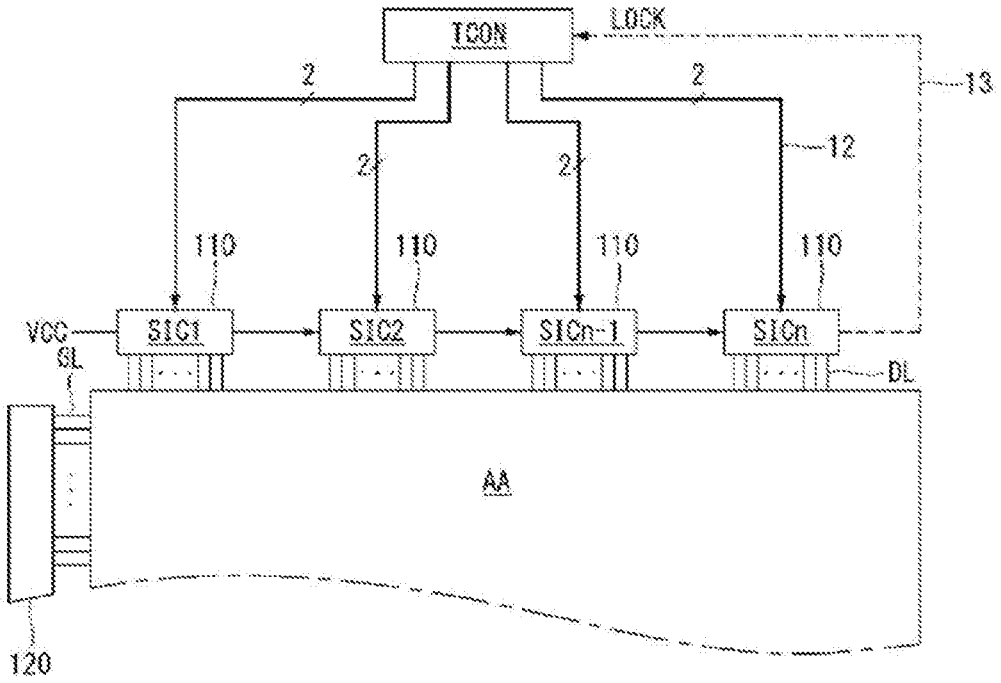
FIG. 2 is a diagram illustrating an embedded clock point-to-point interface (EPI) topology for connecting a timing controller and source drive integrated circuits (ICs) according to an embodiment of the present disclosure.

Referring to FIGS. 1 and 2, the display device according to the embodiment of the present disclosure includes a display panel 100 and a display panel driver.

The display panel 100 includes a screen AA on which an input image is reproduced. The screen AA includes a pixel array in which pixel data of the input image is displayed. The pixel array includes a plurality of data lines DL, a plurality of gate lines GL intersecting the data lines DL, and a plurality of pixels.

The pixels may be disposed on the screen AA in a matrix form defined by the data lines DL and the gate lines GL. The pixels may be disposed on the screen AA in various forms such as a form in which pixels emitting the same color of light are shared, a stripe form, a diamond form, and the like in addition to the matrix form.

The pixel array includes pixel columns and pixel lines L1 to Ln intersecting the pixel columns. The pixel column includes pixels disposed in a y-axis direction. The pixel line includes pixels disposed in an x-axis direction. One vertical period is one frame period required to write pixel data corresponding to one frame to all pixels of the screen. One horizontal period is the time required to write pixel data corresponding to one line sharing a gate line to pixels of one pixel line. One horizontal period is a time obtained by dividing one frame period by the number of m pixel lines L1 to Lm. Each of the pixels may be divided into a red (R) subpixel, a green (G) subpixel, and a blue (B) subpixel to implement colored light. Each of the pixels may further include a white subpixel. Subpixels 101 include the same pixel circuit.

In the case of an organic light-emitting display device, a pixel circuit may include a light-emitting element, a driving element, one or more switching elements, and a capacitor. The light-emitting element may be implemented as an organic light-emitting diode (OLED). A current of the OLED may be adjusted according to a voltage between a gate and a source of the driving element. The driving element and the switching element may be implemented as transistors. The pixel circuit is connected to data lines DL and gate lines GL. In the circle of FIG. 1, "D1 to D3" denote data lines, and "Gn-2 to Gn" denote gate lines. The subpixels 101 may include the same pixel circuit.

Touch sensors may be disposed on the display panel 100. A touch input may be sensed using separate touch sensors or may be sensed through pixels. The touch sensors may be disposed on the screen AA of the display panel 100 in an on-cell type or an add-on type or may be implemented as in-cell type touch sensors embedded in a pixel array.

The display panel driver includes a data driver 110 and a gate driver 120. The display panel driver writes pixel data of an input image to the pixels of the display panel 100 under control of a timing controller TCON 130.

The data driver 110 converts pixel data SDATA of an input image received from the timing controller 130 into a gamma compensation voltage using a digital to analog converter (hereinafter, referred to as "DAC"), thereby generating a data voltage. The data driver 110 supplies the data voltage to the data lines DL. A pixel data voltage is supplied to the data lines DL and applied to the pixel circuits of the subpixels 101 through the switching elements. As shown in FIG. 2, the data driver 110 may be implemented as one or more source drive integrated circuits (ICs) SIC1 to SICn.

The gate driver 120 may be formed in a bezel region BZ outside the screen, on which an image is not displayed, in the display panel 100. The gate driver 120 sequentially supplies gate signals synchronized with the data voltage to the gate lines GL under control of the timing controller 130. The gate signal concurrently selects pixel lines in which the data voltage is charged.

The gate driver 120 outputs a gate signal using one or more shift registers and shifts the gate signal. The gate signal may include one or more scan signals and a light emission control signal EM.

The timing controller 130 receives pixel data DATA of an input image from a host system (not shown) and receives a timing signal synchronized with the pixel data DATA. The timing signal includes a vertical synchronization signal Vsync, a horizontal synchronization signal Hsync, a clock signal DCLK, and a data enable signal DE. Since a vertical period and a horizontal period may be known through a method of counting the data enable signal DE, the vertical synchronization signal Vsync and the horizontal synchronization signal Hsync may be omitted.

The timing controller 130 generates a source timing control signal DDC for controlling an operation timing of the data driver 110 and a gate timing control signal GDC for controlling an operation timing of the gate driver 120 using the timing signals Vsync, Hsync, and DE received from the host system. The source timing control signal DDC generates a source output enable (SOE) signal for controlling an output timing of each of the source drive ICs SIC1 to SICn and generates a latch output control signal (hereinafter, referred to as "CLAT signal") for controlling an output timing of a latch in each of the source drive ICs SIC1 to SICn. The SOE signal and the CLAT signal control a latch output timing and a buffer output timing of each of the source drive ICs SIC1 to SICn every horizontal period. Therefore, pulses of the SOE signal and CLAT signal are generated every horizontal period.

The timing controller 130 may control an operation timing of the display panel driver at a frame frequency of input frame frequency×i Hz obtained by multiplying an input frame frequency by i (wherein i is a positive integer greater than zero). The input frame frequency is 60 Hz in a National Television Standard Committee (NTSC) standard and 50 Hz in a Phase Alternating Line (PAL) standard.

The host system may be any one of a television (TV), a set top box, a navigation system, a personal computer (PC), a home theater, a mobile device, and a wearable device. In the mobile device and the wearable device, the data driver 110, the timing controller 130, and a level shifter 140 may be integrated into one drive IC.

The level shifter 140 converts voltages of the gate timing control signal GDC output from the timing controller 130 into a gate high voltage VGH and a gate low voltage VGL and supplies the gate high voltage VGH and the gate low voltage VGL to the gate driver 120. A low level voltage of the gate timing control signal GDC is converted into the gate low voltage VGL, and a high level voltage of the gate timing control signal GDC is converted into the gate high voltage VGH.

The timing controller 130 may transmit pixel data to the source drive ICs SIC1 to SICn through an embedded clock point-to-point interface (EPI). As shown in FIG. 2, the EPI may connect the timing controller 130 and the source drive ICs SIC1 to SICn in a point-to-point manner to minimize the number of lines between the timing controller 130 and the source driver ICs SIC1 to SICn. Since an EPI signal including control data and pixel data, which are embedded with a clock, is transmitted through data line pairs 12, the EPI does not require additional clock lines and control lines.

The data line pairs 12 may be divided for each source drive IC to connect the timing controller 130 to the source drive ICs SIC1 to SICn. The timing controller 130 and the source drive ICs SIC1 to SICn may be connected in series through the data line pairs 12.

Figure 6:
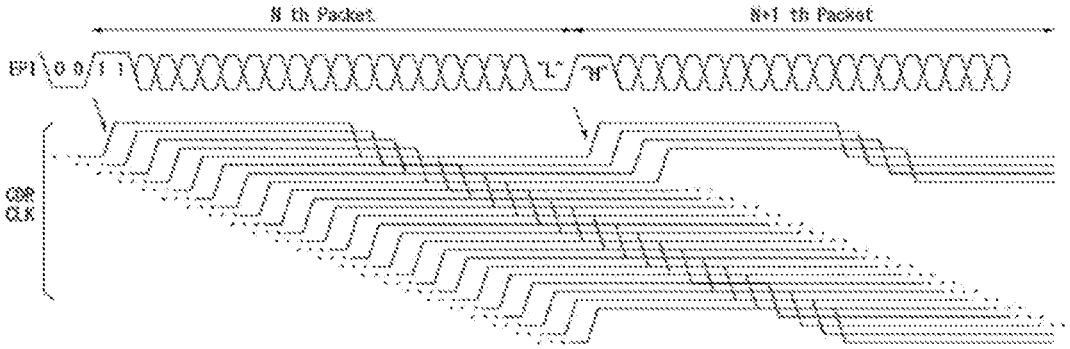
FIG. 6 is a waveform diagram illustrating an internal clock recovered in a source drive according to an embodiment of the present disclosure.

In the case of the EPI, each of the source drive ICs SIC1 to SICn may include a clock recovery unit (not shown) for clock and data recovery (CDR). The timing controller 130 transmits a clock training pattern signal or a preamble signal to the source drive ICs SIC1 to SICn so that an output phase and a frequency of the clock recovery unit are locked. When a clock training pattern signal and a clock signal of the EPI signal received through the data line pair 12 are input, the clock recovery unit embedded in the source drive ICs SIC1 to SICn recovers the clock signal to generate multi-phase internal clocks CDR CLK as shown in FIG. 6.

When a phase and a frequency of the internal clock CDR CLK are locked, the source drive ICs SIC1 to SICn feed a lock signal LOCK at a high logic level indicating an output stabilization state back to the timing controller 130. A direct current (DC) power voltage VCC at a high logic level is input to a lock signal input terminal of a first source drive IC SIC1. The lock signal LOCK is fed back to the timing controller 130 through a lock feedback line 13 connected to the timing controller and a last source drive IC SICn.

In a signal transmission protocol of the EPI, the timing controller 130 transmits a clock training pattern signal to the source drive ICs SIC1 to SICn before transmitting control data and pixel data of an input image. The clock recovery unit of the source drive ICs SIC1 to SICn performs a clock training operation based on the clock training pattern signal to recover a clock received through the data line pair 12 and generate an internal clock. When a phase and a frequency of the internal clock are stably locked, the clock recovery unit establishes a data link with the timing controller 130.

In response to the lock signal LOCK received from the last source drive IC SICn, the timing controller 130 starts to transmit the control data and the pixel data to the source drive ICs SIC1 to SICn through the data line pairs 12. An output signal of the timing controller 130 is converted into a differential signal through a transmission end buffer of the timing controller 130 and transmitted to the source drive ICs SIC1 to SICn through the data line pairs 12.

The source drive ICs SIC1 to SICn may sample a control data bit from a signal received through the data line pair 12 at an internal clock timing and may recover the source timing control signal DDC from the sampled control data. The control data may include a control signal for controlling functions of the source drive ICs SIC1 to SICn and the gate driver 120 together with the source timing control signal DDC.

The source drive ICs SIC1 to SICn sample pixel data bits from a signal received through the data line pairs 12 according to the internal clock timing and then convert the sampled pixel data bits into parallel data using a latch. In response to the recovered timing control signal DDC, the source drive ICs SIC1 to SICn convert pixel data into a gamma compensation voltage to output a data voltage. The data voltage is supplied to the data lines DL.

Figure 3:
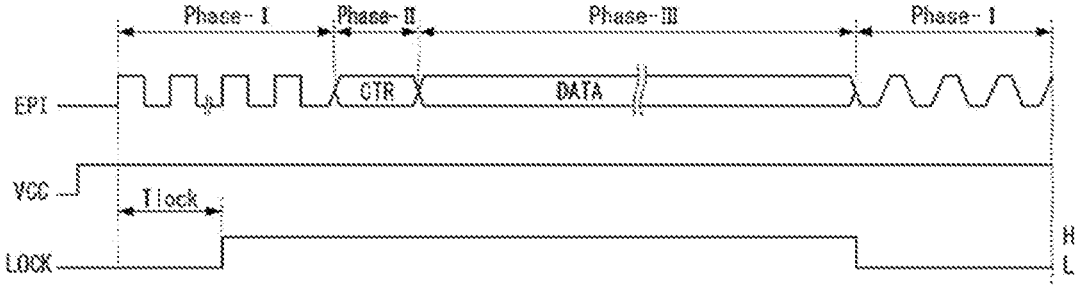
FIG. 3 is a waveform diagram illustrating a signal transmission protocol of an EPI according to an embodiment of the present disclosure.

FIG. 3 is a waveform diagram illustrating a signal transmission protocol of an EPI.

Referring to FIG. 3, the timing controller 130 transmits a clock training pattern signal (or a preamble signal) having a constant frequency to the source drive ICs SIC1 to SICn in a first phase (Phase-I). When a lock signal LOCK at a high logic level (or 1) is input through the lock feedback line 13, the timing controller 130 performs a second phase (Phase-II) to transmit data, i.e., an EPI signal in a signal format defined in an EPI protocol. A control data packet CTR is transmitted to the source drive ICs SIC1 to SICn in the second phase (Phase-II).

The EPI signal (EPI data) includes a control packet and pixel data in an interface signal transmission protocol. When the lock signal LOCK is maintained at a high logic level subsequent to the second phase (Phase-II), the timing controller 130 performs a third phase (Phase-III) to transmit a pixel data packet including pixel data DATA of an input image to the source drive ICs SIC1 to SICn.

The timing controller 130 scrambles the pixel data to reduce electromagnetic interference (EMI) in the data line pair 12. In FIG. 3, DATA denotes pixel data.

In FIG. 3, "Tlock" denotes a period of time until a lock signal is inverted to a high logic level H. During Tlock, a clock training pattern signal may be input to the source drive ICs SIC1 to SICn, and a frequency and a phase of an internal clock output from the clock recovery unit of the source drive ICs SIC1 to SICn may be locked. Thus, the lock signal LOCK may be inverted to the high logic level H. Tlock may denote a period of time that is greater than or equal to one horizontal period.

When a lock signal LOCK at a low logic level L is input from the last source drive IC SICn, in order to resume clock training of the source drive ICs SIC1 to SICn, the timing controller 130 performs the first phase (Phase-I) to transmit a clock training pattern signal to the source drive ICs SIC1 to SICn. When a clock is not normally recovered from the clock recovery unit in an unexpected situation during transmission of a signal of the second phase (Phase-II) and performance of the third phase (Phase-III), any one of the source drive ICs SIC1 to SICn inverts the lock signal LOCK to the low logic level L. In this case, when the lock signal LOCK at the low logic level L is input from the last source drive IC SICn during the transmission of the signal of the second phase (Phase-II) or the performance of the third phase (Phase-III), in response to the lock signal LOCK, the timing controller 130 performs the first phase (Phase-I) to transmit a clock training pattern signal to the source drive ICs SIC1 to SICn. In this case, the control data packet CTR and the pixel data SDATA are not received by the source drive ICs SIC1 to SICn.

Figure 4:
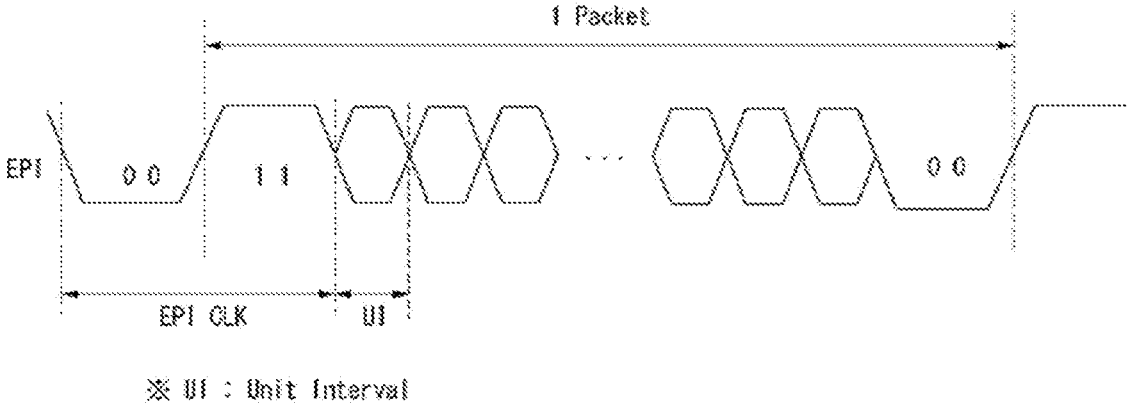
FIG. 4 is a diagram illustrating one data packet in an EPI according to an embodiment of the present disclosure.

FIG. 4 is a diagram illustrating one data packet in an EPI.

Referring to FIG. 4, one data packet of an EPI signal transmitted to the source drive ICs SIC1 to SICn includes data bits and clock bits EPI CLK allocated before and after the data bits. The data bits are bits of control data or pixel data. The time required to transmit one bit is referred to as one unit interval (UI). One UI differs according to resolution of a display panel PNL or the number of data bits.

The clock bits EPI CLK may be allocated for 4 UIs between adjacent data packets, and "0 0 1 1 (or L L H H)" may be allocated as a logic value thereof, but the present disclosure is not limited thereto. When the number of data bits is 10, one pixel data packet may include 30 UIs of data bits and 4 UIs of clock bits. When the number of data bits is 8, one pixel data packet may include 24 UIs of data bits including 8 bits of R subpixel data, 8 bits of G subpixel data, and 8 bits of B subpixel data, and 4 UIs of clock bits. When the number of data bits is 6, one pixel data packet may include 18 UIs of RGB data bits and 4 UIs of clock bits, but the present disclosure is not limited thereto.

One horizontal period 1H may be divided into is a horizontal blank period HB (see FIG. 5) in which pixel data is not transmitted to the source drive ICs SIC1 to SICn and a horizontal active period HA (see FIG. 5) at which pixel data is transmitted to the source drive ICs SIC1 to SICn. A control data packet may be transmitted to the source drive ICs SIC1 to SICn in the horizontal blank period HB.

Figure 5:
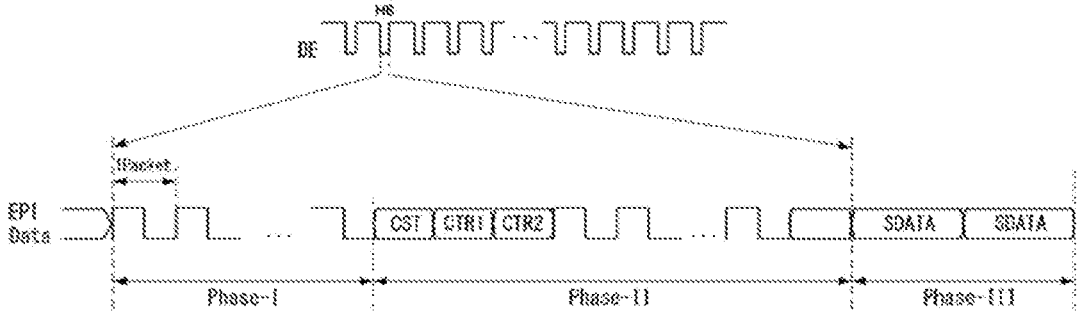
FIG. 5 is a waveform diagram illustrating an EPI signal transmitted during a horizontal blank period according to an embodiment of the present disclosure.

In an EPI protocol, a first phase (Phase-I) and a second phase (Phase-II) are performed in the horizontal blank period HB of one horizontal period (1H). The horizontal blank period HB corresponds to a low logic level period of a data enable signal DE. In FIG. 5, "DE" denotes the data enable signal DE. One pulse period of the data enable signal DE is one horizontal period (1H). A high logic period of the data enable signal DE corresponds to the horizontal active period. A third phase (Phase-III) is performed in the high logic period, i.e., in a pulse width of the data enable signal DE to transmit a pixel data packet including pixel data DATA to the source drive ICs SIC1 to SICn FIG. 6 is a waveform diagram illustrating an internal clock recovered in the source drive ICs SIC1 to SICn. In FIG. 6, "EPI" denotes EPI signals received by the source drive ICs SIC1 to SICn through the data line pair 12. "CDR CLK" denotes multi-phase internal clocks output from the clock recovery units of the source drive ICs SIC1 to SICn.

Referring to FIG. 6, the clock recovery unit of each of the source drive ICs SIC1 to SICn outputs a multi-phase internal clock CDR CLK using a phase locked loop (PLL) or a delay locked loop (DLL). The clock recovery unit receives a clock training pattern signal through the data line pair 12 to generate an output. When a phase and a frequency of the output are equal to those of an input clock, the clock recovery unit inverts a lock signal LOCK to a high level and then recovers a clock of the EPI signal to generate the multi-phase internal clock CDR CLK. The multi-phase internal clocks CDR CLK are generated as clocks of which phases are sequentially delayed so that a rising edge of the clock is synchronized with each bit of a data packet. The source drive ICs SIC1 to SICn may sample bits of data at a rising edge of the internal clock CDR CLK.

Figure 7:
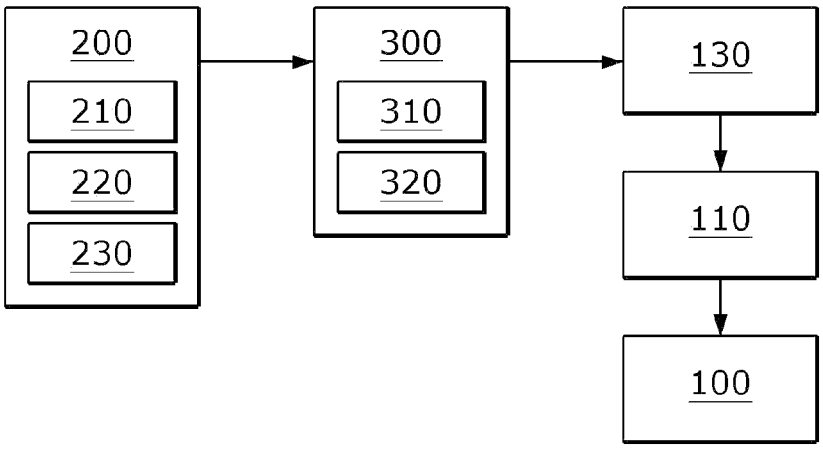
FIG. 7 is a schematic block diagram illustrating a portion of a display device including a wireless signal detection unit and a detection signal output unit according to an embodiment of the present disclosure.

FIG. 7 is a schematic block diagram illustrating a portion of a display device including a wireless signal detection unit and a detection signal output unit.

Referring to FIG. 7, a display device according to an embodiment of the present disclosure may include a wireless signal detection unit 200 and a detection signal output unit 300.

The wireless signal detection unit 200 detects an electromagnetic wave signal. The wireless signal detection unit 200 detects an electromagnetic wave signal around a display panel 100. The wireless signal detection unit 200 detects an electromagnetic wave signal around the display device. The electromagnetic wave signal may refer to a signal transmitted through free space rather than a wired line.

The wireless signal detection unit 200 converts the detected electromagnetic wave signal into an electric signal. The electric signal may refer to a signal transmitted through a potential difference and a flow of electric charges in a conductor. The electric signal may be expressed in the form of voltage or current.

The wireless signal detection unit 200 includes an antenna unit 210, a voltage converting unit (ADC) 230, and an impedance matching unit 220 to convert a detected electromagnetic wave signal into an electric signal.

The antenna unit 210 detects an electromagnetic wave signal and then converts the detected electromagnetic wave signal into an alternating current (AC) electric signal and outputs the AC electric signal.

The antenna unit 210 includes at least one of a spiral antenna, a meander antenna, and a mechanical structure antenna using a structure constituting a display device. In addition, the antenna unit 210 may include various antennas. The antenna unit 210 is designed to detect a signal in a desired communication band. In one embodiment, the antenna unit 210 may be designed as a single spiral antenna having an 800 MHz band characteristic in order to detect a signal in a Global System for Mobile Communications 850 (GSM 850) communication band. In another embodiment, the antenna unit 210 may be designed as a planar inverted-F antenna (PIFA) having a 400 MHz band characteristic in order to detect a signal in a wireless communication band. The PIFA may be included in a stitch meander antenna.

The antenna unit 210 may be provided as one antenna, but the present disclosure is not limited thereto. The antenna unit 210 may be provided as a plurality of antennas. For example, the antenna unit 210 may include a spiral antenna and a mechanical structure antenna.

One antenna is electrically connected to a connection terminal of a printed circuit board on which an impedance matching circuit is printed. In one embodiment, one antenna may be electrically connected to one connection terminal. In another embodiment, one antenna may be electrically connected to two or more connection terminals.

The voltage converting unit (ADC) 230 amplifies and rectifies an AC electric signal output from the antenna unit 210 to convert the AC electric signal into a DC electric signal.

The voltage converting unit (ADC) 230 includes a converting circuit to amplify and rectify an AC electric signal. The converting circuit is provided according to an output condition of the antenna unit 210. Here, the output condition of the antenna unit 210 refers to a voltage value range of an AC electric signal output by the antenna unit 210. For example, the output condition of the antenna unit 210 may refer to a case in which the output AC electric signal is less than 0.3 V. As another example, the output condition of the antenna unit 210 may refer to a case in which the output AC electric signal is 0.3 V or more. As still another example, the output condition of the antenna unit 210 may refer to a case in which the output AC electric signal is 0.1 V or more. As described above, a reason why the converting circuit is provided according to the output condition of the antenna unit 210 is for preventing an overvoltage from being applied to the detection signal output unit 300.

The converting circuit includes at least one of a first conversion circuit, a second conversion circuit, and a third conversion circuit according to the output condition of the antenna unit 210. The first conversion circuit amplifies an AC electric signal. The first conversion circuit includes an operational amplifier element or a bipolar junction transistor. The second conversion circuit rectifies an AC electric signal. As an example, the second conversion circuit may include a capacitor and a diode. The third conversion circuit amplifies and rectifies an AC electric signal at the same time. The third conversion circuit may be a dual voltage circuit. The third conversion circuit may be a one-stage dual voltage circuit or a two-stage dual voltage circuit but is not limited thereto.

The impedance matching unit 220 reduces reflection due to a difference in impedance between the antenna unit 210 and the voltage converting unit (ADC) 230. The impedance matching unit 220 reduces loss of an AC electric signal by reducing reflection loss due to the impedance difference between the antenna unit 210 and the voltage converting unit (ADC) 230 using an impedance matching circuit. The impedance matching circuit improves a signal-to-noise ratio (SNR) by reducing the reflection loss due to the impedance difference between the antenna unit 210 and the voltage converting unit (ADC) 230.

The impedance matching unit 220 is electrically connected to the antenna unit 210 through a connection terminal. The impedance matching unit 220 includes one or more impedance matching circuits so as to correspond to the number of the connection terminals.

The detection signal output unit 300 detects the electromagnetic wave signal using an electric signal. The detection signal output unit 300 compares an electric signal with a preset reference signal and outputs a detection signal according to the comparison result. To this end, the detection signal output unit 300 includes a comparison unit 310 and a switching unit 320.

The comparison unit 310 compares a DC electric signal with the reference signal to output a comparison voltage. When the DC electric signal is greater than the reference signal, the comparison unit 310 outputs a high level comparison voltage. When the DC electric signal is lower than the reference signal, the comparison unit 310 outputs a low level comparison voltage.

The switching unit 320 outputs a detection signal by turning a switching element on or off according to the comparison voltage. When the high level comparison voltage is input, the switching unit 320 turns the switching element on to output a detection signal having a first level (for example, a high level). When the low level comparison voltage is input, the switching unit 320 turns the switching element off to output a detection signal having a second level (for example, a low level).

A timing controller 130 outputs an EPI data signal to a display panel driver 110. The display panel driver 110 writes pixel data onto a plurality of pixels included in a display panel 100 in response to the EPI data signal.

The timing controller 130 converts a signal characteristic of the EPI data signal in response to the detection signal and outputs the EPI data signal. In one embodiment, when the detection signal having the first level is detected, the timing controller 130 raises a voltage identification (VID) value of the EPI data signal to output the EPI data signal. For example, when the detection signal having the first level is detected while the EPI data signal is output at a VID value of 200 mV, the timing controller 130 may raise the VID value of the EPI data signal to 600 mV to output the EPI data signal. In another embodiment, when the detection signal having the first level is detected, the timing controller 130 shifts a frequency band of the EPI data signal to an adjacent frequency band among preset frequency bands to output the EPI data signal. For example, when the detection signal having the first level is detected while the EPI data signal is output in a band of 35 MHz, the timing controller 130 may output the EPI data signal in a band of 36 MHz. As a result, the timing controller 130 may output an EPI data signal that is robust with respect to an electromagnetic wave generation situation around the display device, thereby stably outputting an image.

Figure 8:
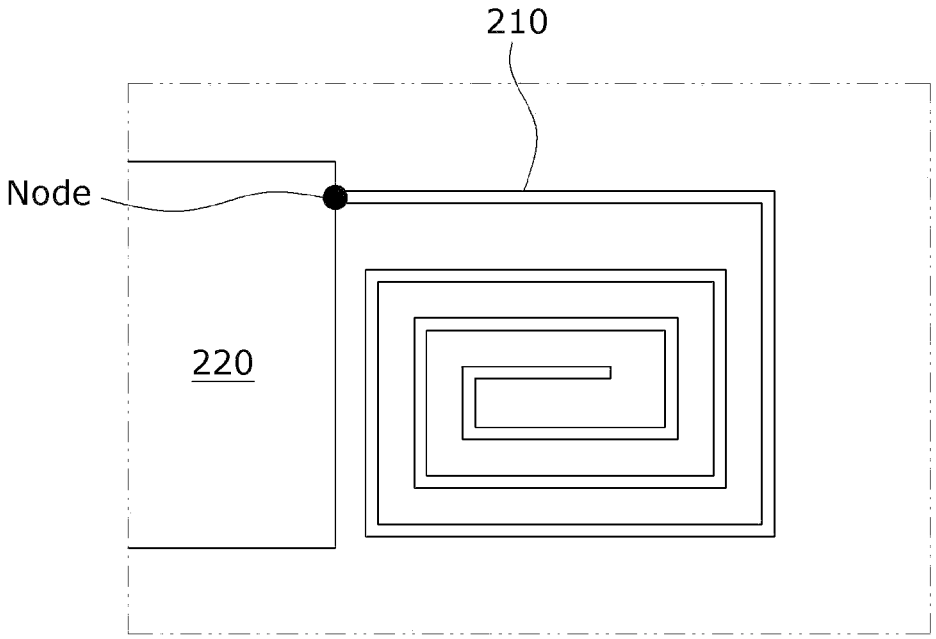
FIGS. 8 to 10 are diagrams illustrating an antenna unit according to an embodiment of the present disclosure.
Figure 9:
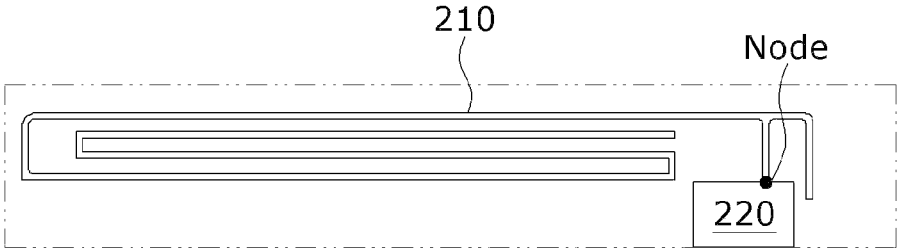
Figure 10:
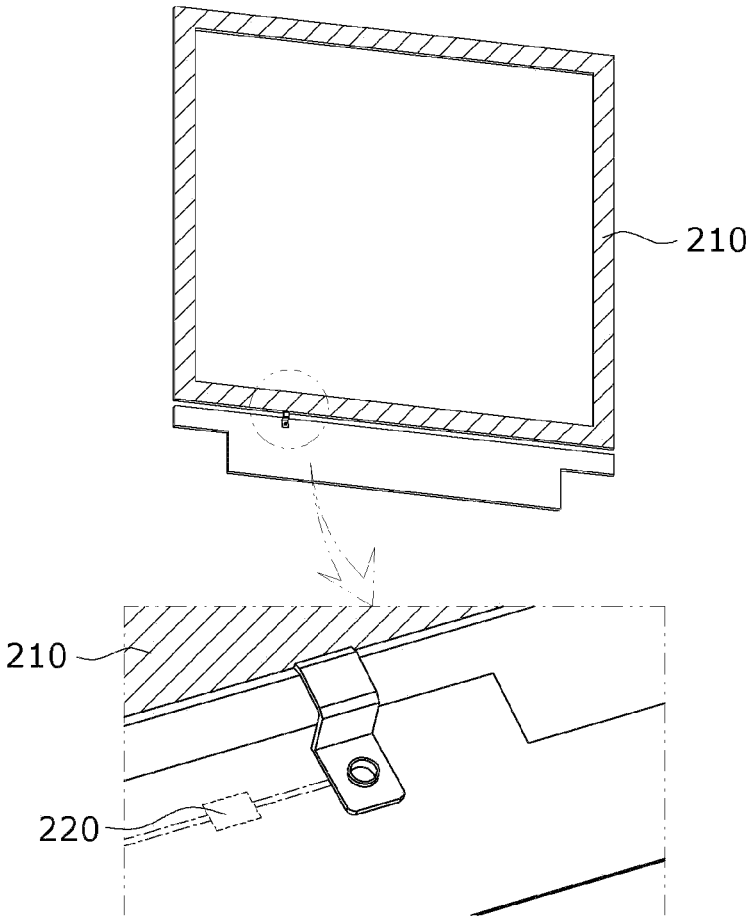

FIGS. 8 to 10 are diagrams illustrating an antenna unit according to an embodiment of the present disclosure.

FIG. 8 is an exemplary diagram of a spiral antenna. The spiral antenna may be a type of printed antenna and may have a form in which a spiral antenna pattern is printed on a substrate. One end of the spiral antenna pattern may be floated, and the other end thereof may be connected to a connection terminal Node of an impedance matching unit 220. The spiral antenna has a wide bandwidth. In one embodiment, the spiral antenna may have a bandwidth of a GSM 850 band. That is, an antenna unit 210 may be implemented as the spiral antenna shown in FIG. 8 in order to detect a signal in the GSM850 band, which is the 800 MHz band.

FIG. 9 is an exemplary diagram of a meander antenna. The meander antenna shown in FIG. 9 is a planar inverted-F antenna (PIFA). The PIFA has a form in which a rectangular patch plate with a smaller area is disposed on a planar ground surface and has a shape in which an F-shape is turned upside down. Therefore, the PIFA may be implemented stereoscopically as compared with a spiral antenna. One end of the PIFA may be connected to a connection terminal Node of the impedance matching unit 220. The PIFA may have a bandwidth for receiving a signal in a wireless communication band. That is, the antenna unit 210 may be implemented as the PIFA shown in FIG. 9 in order to detect a signal in a 400 MHz wireless communication band.

FIG. 10 is an exemplary diagram of a mechanical structure antenna. According to an embodiment of the present disclosure, the mechanical structure antenna 210 may refer to an antenna that detects a surrounding electromagnetic wave using a mechanical structure of a display device. As an example, as shown in FIG. 10, the mechanical structure antenna 210 may be an antenna using a mechanical structure of a bezel portion surrounding a display panel. The mechanical structure of the display device may be implemented with a metal material in order to detect an electromagnetic wave. The mechanical structure antenna 210 using the mechanical structure of the display device is mechanically coupled to the connection terminal of the impedance matching unit 220. The use of the mechanical structure of the bezel portion surrounding the display panel shown in FIG. 10 is an example, and various mechanical structures of the display device may be used as an antenna. When the display device is a smartphone, a housing of the smartphone may also be used as the mechanical structure antenna.

Figure 11:
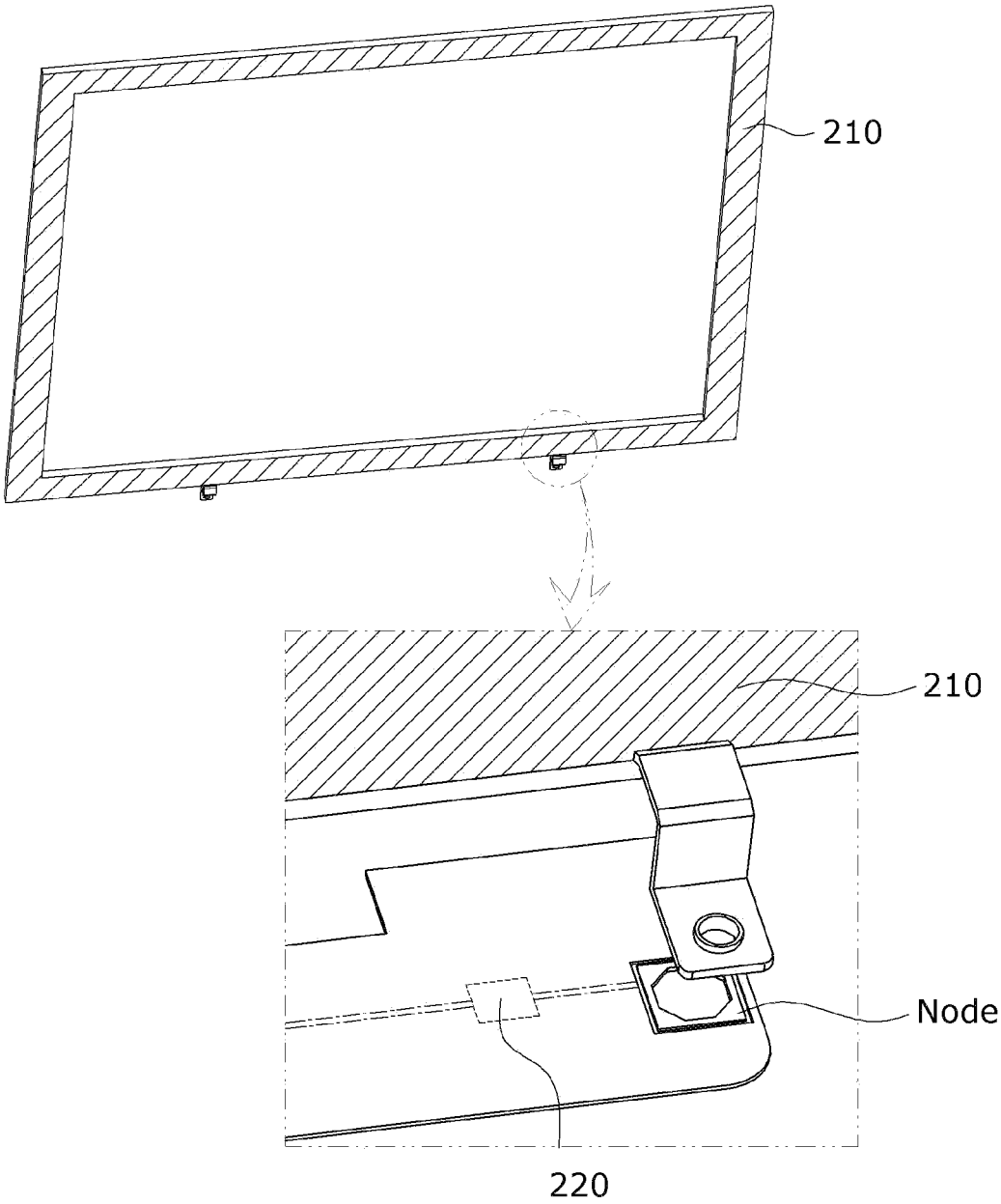
FIGS. 11 and 12 are diagrams illustrating a mechanical connection structure between a mechanical structure antenna and an impedance matching unit according to an embodiment of the present disclosure.
Figure 12:
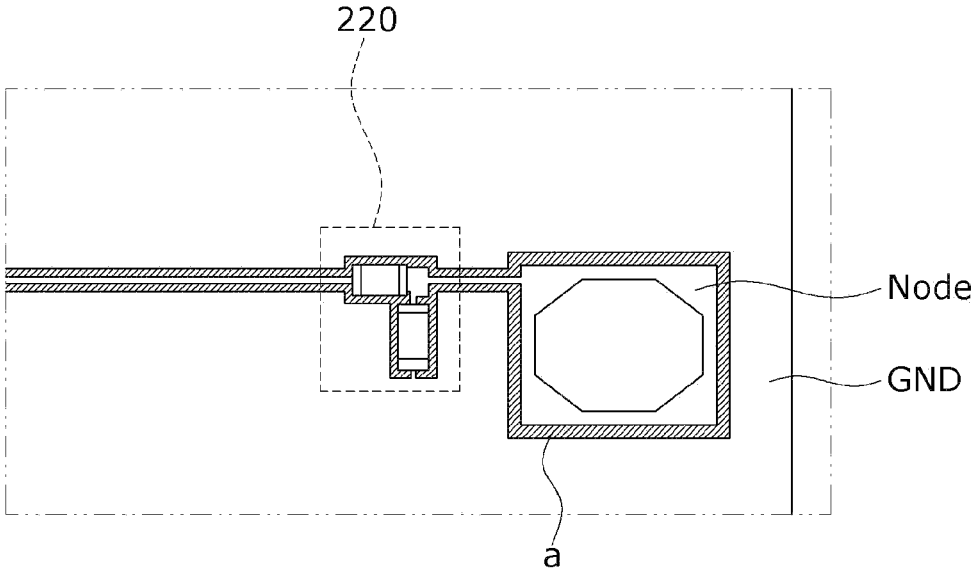

FIGS. 11 and 12 are diagrams illustrating a mechanical connection structure between a mechanical structure antenna and an impedance matching unit.

Referring to FIG. 11, the mechanical structure antenna 210 is mechanically coupled to a connection terminal of an impedance matching unit 220 is printed on a printed circuit board. The mechanical structure antenna may be mechanically coupled to a connection terminal Node of the impedance matching unit 220 is disposed on the printed circuit board, through a coupling member such as a bolt. In this case, since the impedance matching unit 220 is disposed on the printed circuit board, it is necessary to electrically separate the connection terminal of the impedance matching unit 220 from a ground terminal of the printed circuit board on which the impedance matching unit 220 is printed. When the connection terminal is not separated from the ground terminal, an AC electric signal output by the antenna unit 210 does not flow to the impedance matching unit 220 but flows to a ground terminal GND of the printed circuit board.

Thus, as shown in FIG. 12, the connection terminal is disposed to be spaced apart from the ground terminal GND of the printed circuit board. A groove a is formed between the connection terminal and the printed circuit board, and the connection terminal and the printed circuit board are electrically insulated from each other due to the groove a. Accordingly, an AC electric signal output by the mechanical structure antenna is transmitted to the impedance matching unit 220 through the connection terminal Node.

Figure 13:
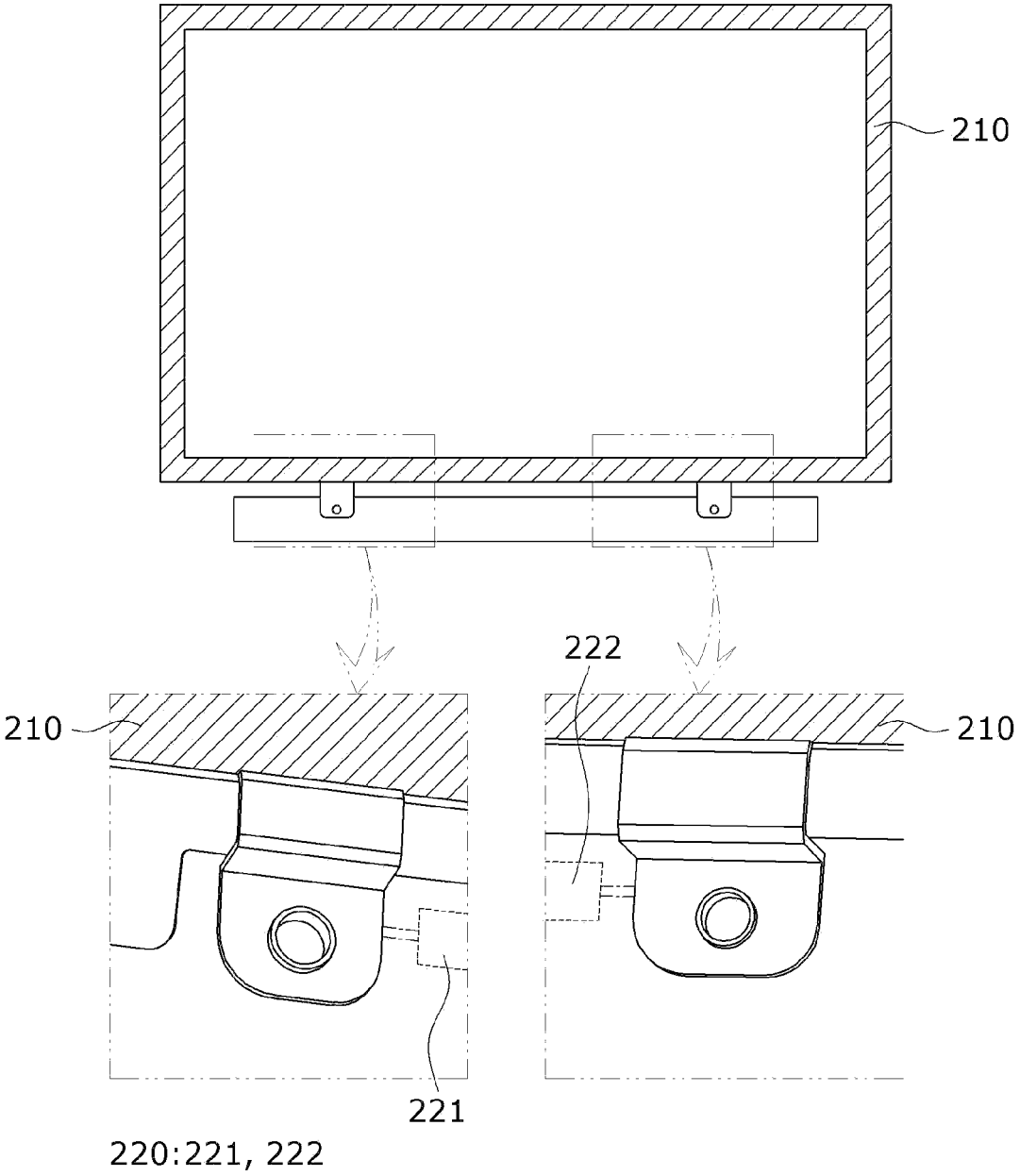
FIG. 13 is a diagram illustrating an example of a mechanical structure antenna according to an embodiment of the present disclosure.
Figure 14:
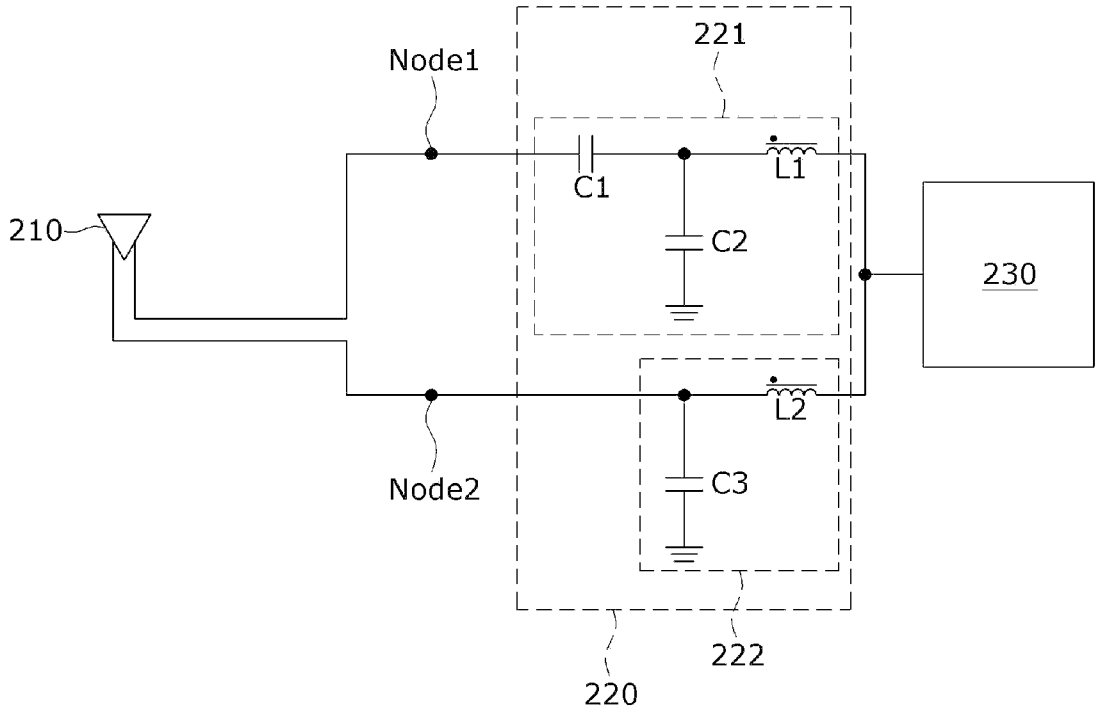
FIG. 14 is a circuit diagram of a wireless signal detection unit of FIG. 13 according to an embodiment of the present disclosure.

FIG. 13 is a diagram illustrating an example of a mechanical structure antenna according to an embodiment, and FIG. 14 is a circuit diagram of a wireless signal detection unit of FIG. 13.

Referring to FIGS. 13 and 14, the mechanical structure antenna 210 according to the embodiment of the present disclosure may be connected to an impedance matching unit 220 through two connection terminals. The mechanical structure antenna 210 is coupled to each of two connection terminals Node1 and Node2 of the impedance matching unit 220 printed on a printed circuit board. The impedance matching unit 220 includes impedance matching circuits corresponding to the connection terminals. One impedance matching circuit 221 is connected to a first connection terminal Node1, and the other impedance matching circuit 222 is connected to a second connection terminal Node2. The two impedance matching circuits may have different structures. For example, as shown in the drawing, one impedance matching circuit 221 may be provided with two capacitors C1 and C2 and one inductor L1, and the other impedance matching circuit 222 may be provided with one capacitor C3 and one inductor L2. The two impedance matching circuits 221 and 222 are connected to a voltage converting unit (ADC) 230 through one node. A wireless signal detection unit 200 may detect a wideband frequency as compared with a case in which one connection terminal is used.

Figure 15:
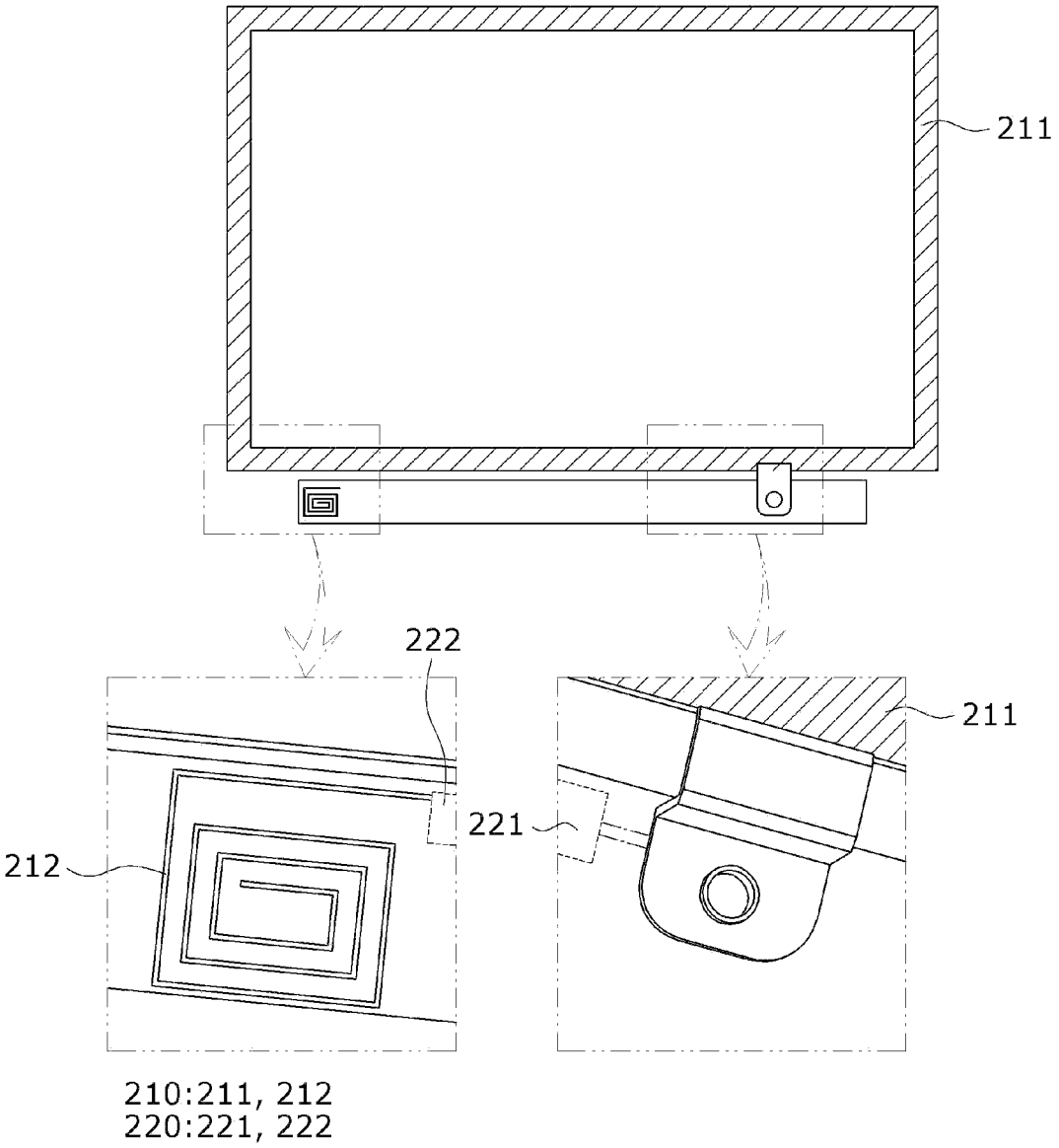
FIG. 15 is a diagram illustrating an example of a wireless signal detection unit using different types of antennas according to an embodiment according to an embodiment of the present disclosure.
Figure 16:
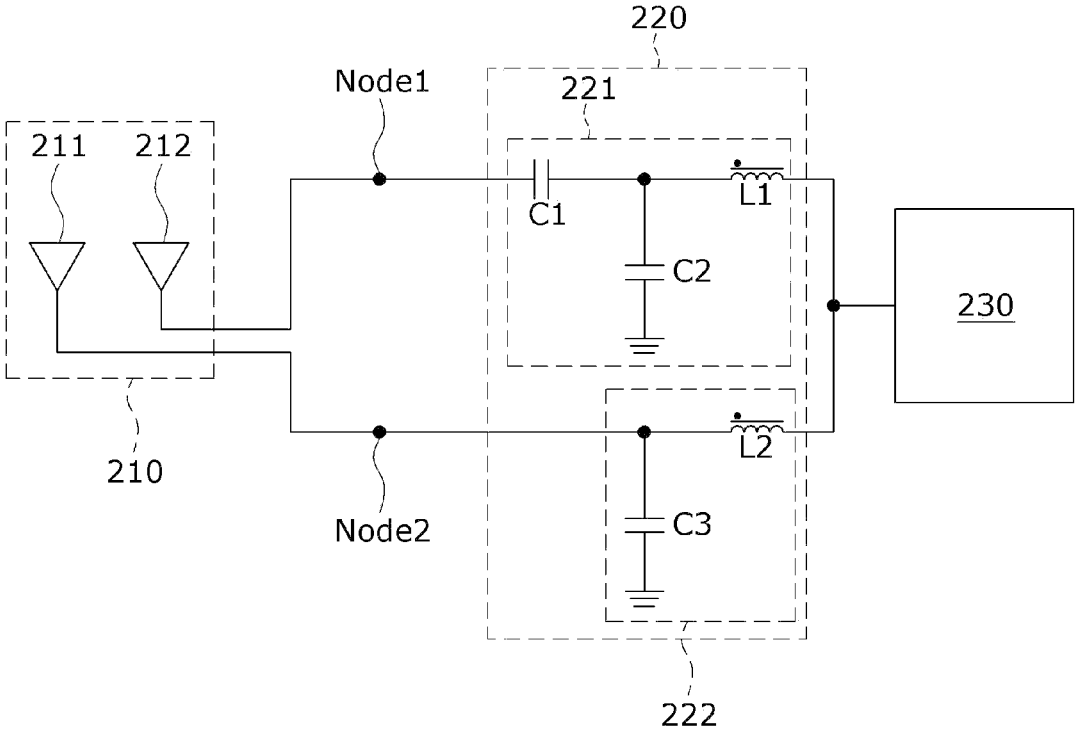
FIG. 16 is a circuit diagram of the wireless signal detection unit of FIG. 15 according to an embodiment of the present disclosure.

FIG. 15 is a diagram illustrating an example of a wireless signal detection unit using different types of antennas according to an embodiment. FIG. 16 is a circuit diagram of the wireless signal detection unit of FIG. 15.

Referring to FIGS. 15 and 16, an antenna unit 210 according to the embodiment of the present disclosure may include antennas having different structures. As an example, the antenna unit 210 may include a mechanical structure antenna and a spiral antenna. Antennas 211 and 212 having different structures are coupled to two connection terminals Node1 and Node2 of an impedance matching unit 220 printed on a printed circuit board, respectively. The impedance matching unit 220 includes impedance matching circuits corresponding to the connection terminals. One impedance matching circuit 221 is connected to a first antenna 211 through a first connection terminal Node1, and the other impedance matching circuit 222 is connected to a second antenna 212 through a second connection terminal Node2. The two impedance matching circuits may have different structures. For example, as shown in the drawing, one impedance matching circuit 221 may be provided with two capacitors C1 and C2, and one inductor L1, and the other impedance matching circuit 222 may be provided with one capacitor C3, and one inductor L2. The two impedance matching circuits 221 and 222 are connected to a voltage converting unit (ADC) 230 through one node. A wireless signal detection unit 200 may detect a wideband frequency as compared with a case in which one antenna is used. In addition, the wireless signal detection unit 200 may have a wide radiation angle and may receive various types of polarized waves.

Figure 17:
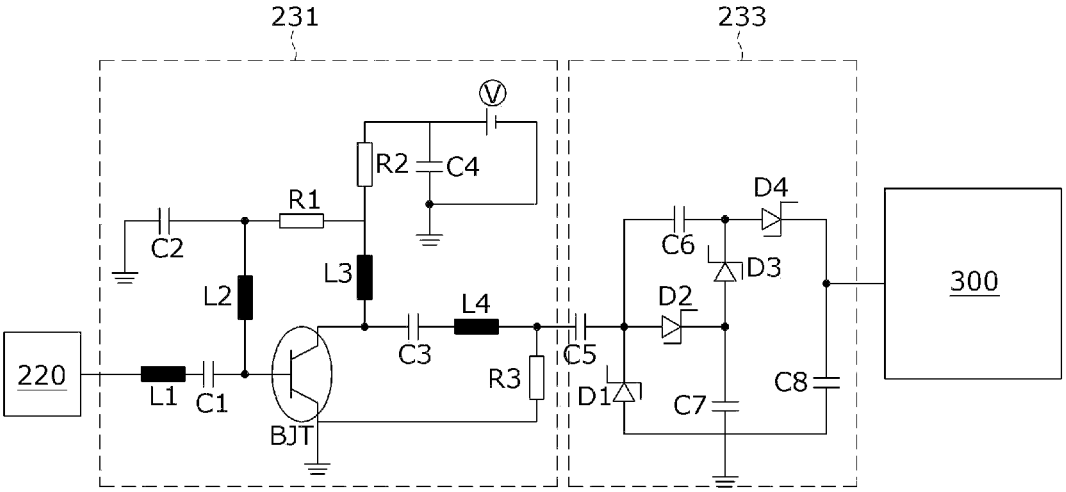
FIG. 17 is a diagram illustrating a voltage converting unit (ADC) according to an embodiment of the present disclosure.

FIG. 17 is a diagram illustrating a voltage converting unit (ADC) according to an embodiment of the present disclosure.

FIG. 17 shows a converting circuit when an antenna unit 210 is designed to output an AC electric signal in a range that is less than a first voltage value. In this case, the first voltage value may be 0.3 V.

The converting circuit may include a first conversion circuit 231 and a third conversion circuit 233. The first conversion circuit 231 may refer to a circuit that amplifies an AC electric signal. The first conversion circuit 231 may amplify an AC electric signal using a bipolar junction transistor. For example, as shown in the drawing, the first conversion circuit 231 may be provided with three resistors R1, R2 and R3, four capacitors C1, C2, C3 and C4, and four inductors L1, L2, L3 and L4, and one bipolar junction transistor BJT. The third conversion circuit 233 may refer to a circuit that amplifies and rectifies an AC electric signal. That is, the third conversion circuit 233 may amplify an input AC electric signal and simultaneously convert the input AC electric signal into a DC electric signal. The third conversion circuit 233 may include a dual voltage circuit. The dual voltage circuit may be a two-stage dual voltage circuit. For example, as shown in the drawing, the third conversion circuit 233 may be provided with four capacitors C5, C6, C7 and C8, and four diodes D1, D2, D3 and D4.

Referring to FIG. 17, the first conversion circuit 231 amplifies an AC electric signal input from an impedance matching unit 220. The AC electric signal amplified by the first conversion circuit 231 is input to the third conversion circuit 233. The third conversion circuit 233 amplifies and rectifies the AC electric signal input from the first conversion circuit 231 to output a DC electric signal. The DC electric signal is input to a detection signal output unit 300.

The converting circuit shown in FIG. 17 may be applied when the antenna unit 210 outputs an AC electric signal having a voltage amplitude lower than the first voltage value (for example, 0.3 V). When an AC electric signal having a voltage amplitude higher than the first voltage value is input to the converting circuit, an overvoltage may be applied to the detection signal output unit 300 due to a DC electric signal output through the converting circuit, thereby resulting in damage or malfunction of the detection signal output unit 300.

Figure 18:
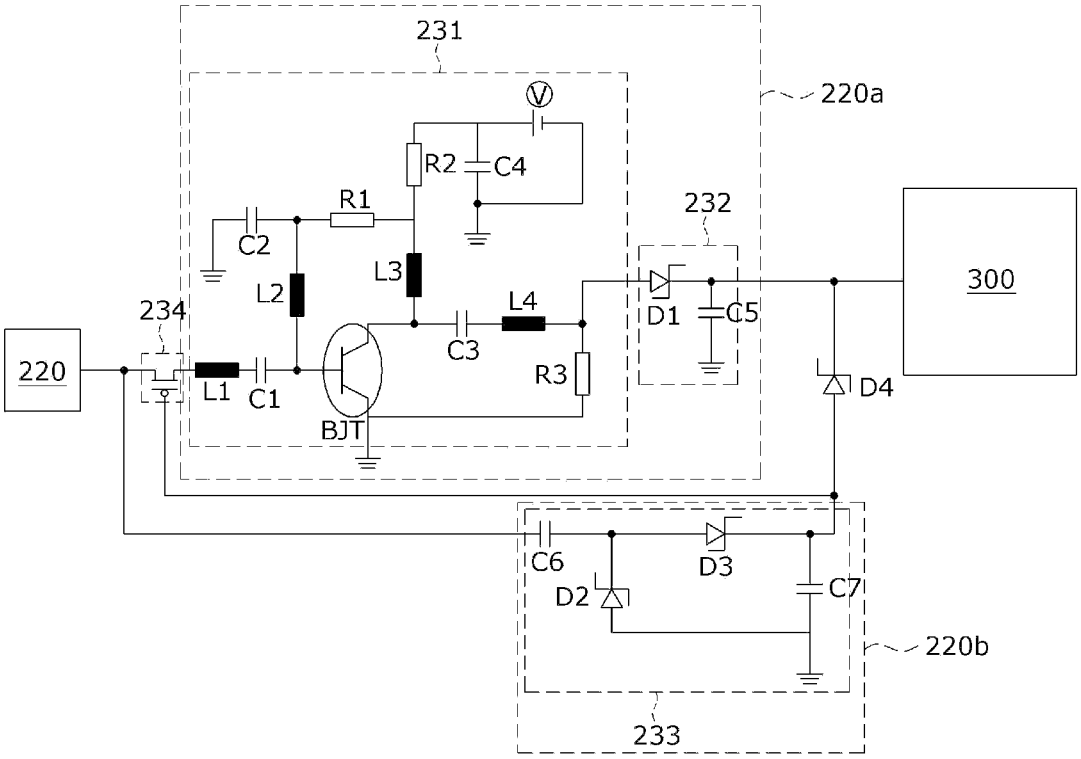
FIGS. 18 and 19 are diagrams illustrating a voltage converting unit (ADC) according to another embodiment of the present disclosure.
Figure 19:
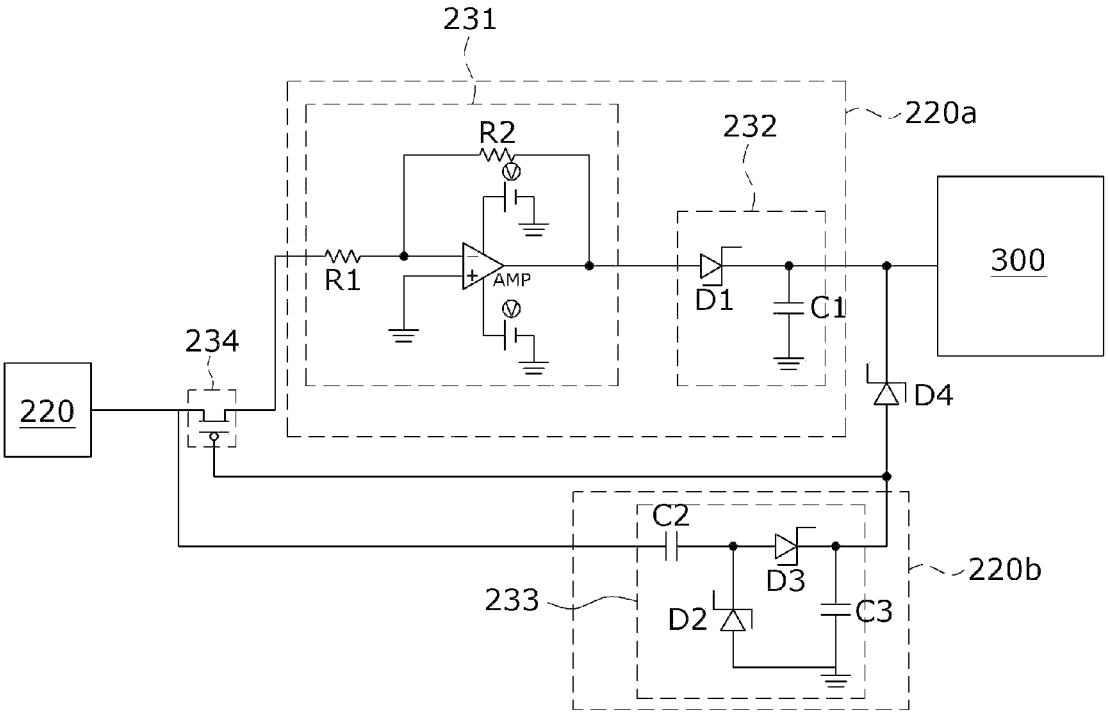

FIGS. 18 and 19 are diagrams illustrating a voltage converting unit (ADC) according to another embodiment of the present disclosure.

FIG. 18 shows a converting circuit when an antenna unit 210 is designed to output an AC electric signal in a range that is greater than or equal to a second voltage value. The second voltage value may be smaller than the first voltage value described with reference to FIG. 17. The second voltage value may be 0.1 V.

The converting circuit may include a plurality of converting circuits 220*a* and 220*b*. The converting circuit may include a first converting circuit 220*a* and a second converting circuit 220*b*. The converting circuit may include a switching element 234 for selectively outputting a DC electric signal of any one of the first converting circuit 220*a* and the second converting circuit 220*b*.

The first converting circuit 220*a* may include a first conversion circuit 231 and a second conversion circuit 232. The first conversion circuit 231 may refer to a circuit that amplifies an AC electric signal. As shown in FIG. 18, the first conversion circuit 231 may amplify an AC electric signal using a bipolar junction transistor. The second conversion circuit 232 may refer to a circuit that rectifies an AC electric signal. That is, the second conversion circuit 232 does not convert a magnitude of an AC electric signal but converts the AC electric signal into a DC electric signal. For example, as shown in FIG. 18, the first conversion circuit 231 may be provided with three resistors R1, R2 and R3, four capacitors C1, C2, C3 and C4, and four inductors L1, L2, L3 and L4, and one bipolar junction transistor BJT. And, the second conversion circuit 232 may be provided with one diode D1, and one capacitor C5.

As another example, as shown in FIG. 19, the first conversion circuit 231 may amplify an AC electric signal using an operational amplifier element. When the operational amplifier element is used, it is advantageous for small signal amplification as compared with when the bipolar junction transistor is used. The second conversion circuit 232 may refer to a circuit that rectifies an AC electric signal. That is, the second conversion circuit 232 does not convert a magnitude of an AC electric signal but converts the AC electric signal into a DC electric signal. For example, as shown in FIG. 19, the first conversion circuit 231 may be provided with two resistors R1 and R2, and one operational amplifier AMP. And, the second conversion circuit 232 may be provided with one diode D1, and one capacitor C1.

The second converting circuit 220*b* may be provided with a third conversion circuit 233. The third conversion circuit 233 may refer to a circuit that amplifies and rectifies an AC electric signal. That is, the third conversion circuit 233 may amplify an input AC electric signal and simultaneously convert the input AC electric signal into a DC electric signal. The third conversion circuit 233 may include a dual voltage circuit. The dual voltage circuit may be a one-stage dual voltage circuit. For example, as shown in FIG. 18, the third conversion circuit 233 may be provided with two capacitors C6 and C7, and two diodes D2 and D3. And, one diode D4 may be provided between the second conversion circuit 232 and the third conversion circuit 233. For other example, as shown in FIG. 19, the third conversion circuit 233 may be provided with two capacitors C2 and C3, and two diodes D2 and D3. And, one diode D4 may be provided between the second conversion circuit 232 and the third conversion circuit 233.

Referring to FIG. 18, an AC electric signal input from an impedance matching unit 220 is input to the first converting circuit 220*a* and the second converting circuit 220*b*. The first converting circuit 220*a* amplifies the input AC electric signal using the first conversion circuit 231 and rectifies the input AC electric signal using the second conversion circuit 232 to output a DC electric signal. The second converting circuit 220*b* amplifies and rectifies the input AC electric signal using the third conversion circuit 233 to output a DC electric signal. Output terminals of the first converting circuit 220*a* and the second converting circuit 220*b* are connected to the same node. Accordingly, among the DC electric signals of the first converting circuit and the second converting circuit, the DC electric signal having a high voltage level is transmitted to a detection signal output unit 300. In this case, since a signal amplification factor of the first converting circuit is greater than a signal amplification factor of the second converting circuit, a DC electric signal output by the first converting circuit is transmitted to the detection signal output unit 300.

Meanwhile, an output of the second converting circuit 220*b* is transmitted to a switching element 234. When a certain voltage is applied, the switching element 234 is turned off to block an AC electric signal output from the impedance matching unit 220 from being input to the first converting circuit 220*a*. That is, when a DC electric signal of a wireless signal detection unit 200 has a voltage of a certain level or more, the switching element is turned off by the output of the second converting circuit, and the output of the second converting circuit is input to the detection signal output unit 300. That is, according to the embodiment shown in FIG. 18, the voltage converting unit (ADC) 230 transmits the output of the first converting circuit to the detection signal output unit 300 when a voltage amplitude of the AC electric signal is greater than or equal to the second voltage value and is less than a certain voltage value. When a voltage amplitude of the AC electric signal is greater than or equal to the certain voltage value, the voltage converting unit (ADC) 230 transmits the output of the second converting circuit to the detection signal output unit 300. Thus, it is possible to prevent an overvoltage from being applied to the detection signal output unit 300. For example, when an AC electric signal in a range that is greater than or equal to 0.1 V and is less than 0.3 V is input from the impedance matching unit 220, the voltage converting unit (ADC) 230 transmits a DC electric signal output by the first converting circuit 220*a* to the detection signal output unit 300. When an AC electric signal in a range that is greater than or equal to 0.3 V is input from the impedance matching unit 220, the voltage converting unit (ADC) 230 transmits a DC electric signal output by the second converting circuit 220*b* to the detection signal output unit 300.

Figure 20:
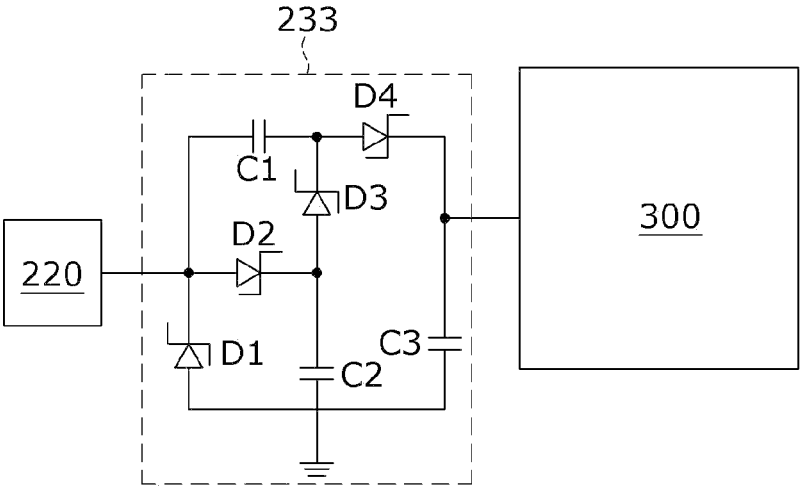
FIG. 20 is a diagram illustrating a voltage converting unit (ADC) according to still another embodiment of the present disclosure.

FIG. 20 is a diagram illustrating a voltage converting unit (ADC) according to still another embodiment of the present disclosure.

FIG. 20 shows a converting circuit when an antenna unit 210 is designed to output an AC electric signal in a range that is greater than or equal to a first voltage value. In this case, the first voltage value may be 0.3 V.

The converting circuit may include a third conversion circuit 233. The third conversion circuit 233 may refer to a circuit that amplifies and rectifies an AC electric signal. That is, the third conversion circuit 233 may amplify an input AC electric signal and simultaneously convert the input AC electric signal into a DC electric signal. The third conversion circuit 233 may include a dual voltage circuit. The dual voltage circuit may be a two-stage dual voltage circuit. For example, as shown in FIG. 20, the third conversion circuit 233 may be provided with three capacitors C1, C2 and C3, and four diodes D1, D2, D3 and D4.

Figure 21:
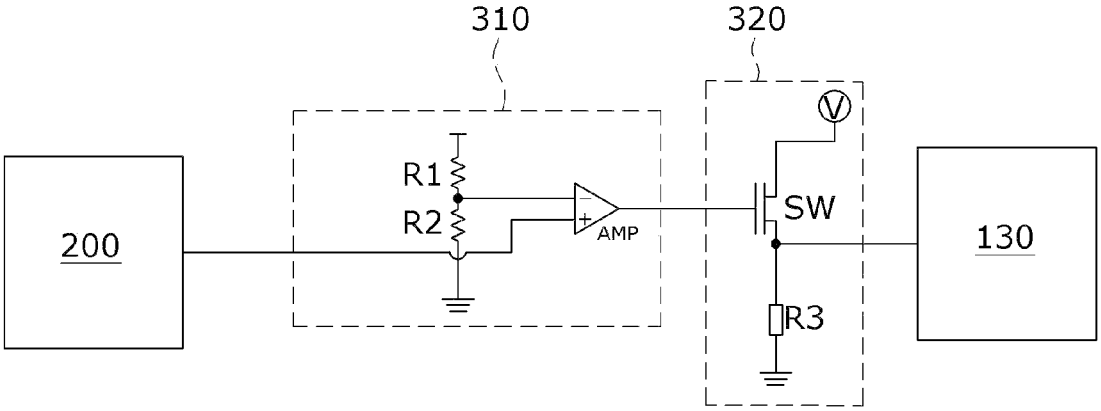
FIG. 21 is a diagram for describing a detection signal output unit according to an embodiment of the present disclosure.

FIG. 21 is a diagram for describing a detection signal output unit according to an embodiment of the present disclosure.

Referring to FIG. 21, a detection signal output unit 300 may include a comparison unit 310 and a switching unit 320.

The comparison unit 310 compares a DC electric signal output from a wireless signal detection unit 200 with a reference signal to output a comparison voltage. The comparison unit 310 may compare the DC electric signal with the reference signal using a comparator circuit. The comparator circuit may include a comparator element and a plurality of resistor elements. For example, the reference signal may be input to a negative input terminal of the comparator element through voltage distribution using the plurality of resistor elements, and the DC electric signal may be input to a positive input terminal of the comparator element. The reference signal may be determined by the plurality of resistor elements connected to one end of the comparator element. That is, the reference signal is determined according to the resistance value setting of the plurality of resistor elements. When the DC electric signal is greater than the reference signal, the comparator element may output a high level comparison voltage. When the DC electric signal is less than or equal to the reference signal, the comparator element may output a low level comparison voltage. For example, as shown in FIG. 21, the comparison unit 310 may be provided with two resistors R1 and R2, and one operational amplifier AMP.

A switching unit 320 controls a voltage output according to a comparison voltage to generate a detection signal. The switching unit 320 may include a switching element, a power source, and a resistor element. The detection signal may have a voltage magnitude of a first level or a second level. The first level may be a high level, and the second level may be a low level. When the high level comparison voltage is input, the switching unit 320 turns the switching element on to output a detection signal having a voltage magnitude of the first level to a timing controller 130. When the low level comparison voltage is input, the switching unit 320 turns the switching element off to output a detection signal having a voltage magnitude of the second level to the timing controller 130. For example, as shown in FIG. 21, the switching unit 320 may be provided with one switching element SW, and one resistor R3.

Figure 22:
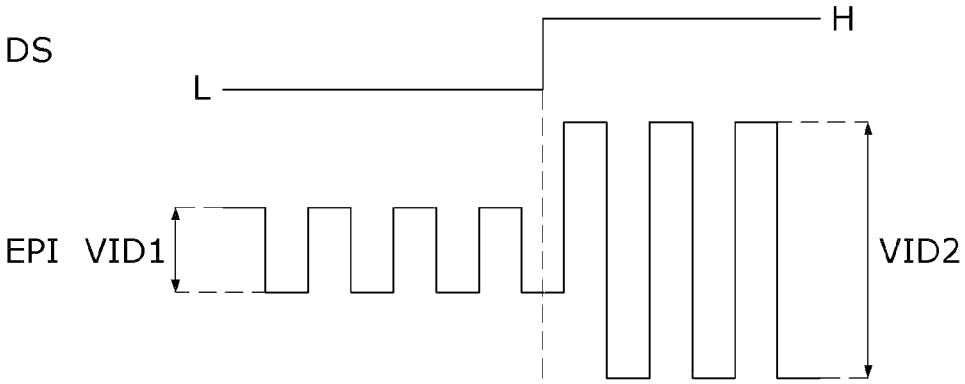
FIG. 22 is a diagram for describing a process of controlling a voltage identification (VID) value of an EPI data signal according to an embodiment of the present disclosure.

FIG. 22 is a diagram for describing a process of controlling a VID value of an EPI data signal according to an embodiment of the present disclosure.

When a detection signal having a voltage magnitude of a first level is received from the detection signal output unit 300, a timing controller 130 converts a preset signal characteristic of the EPI data signal to output the EPI data signal. Specifically, when the detection signal having the voltage magnitude of the first level is received, the timing controller 130 raises a VID value of the EPI data signal to output the EPI data signal.

Referring to FIG. 22, when a detection signal DS is output at the second level, the EPI data signal having the VID value of VID1 is output. When the detection signal is output at the second level, an electromagnetic wave signal, which is enough to interfere with an output of a display device, is not detected, and thus, the EPI data signal having the VID value of VID1 is output.

However, when the detection signal DS is output at the first level, the VID value of the EPI data signal is raised to a magnitude of VID2. When the detection signal is output at the first level, an electromagnetic wave signal, which is enough to interfere with the output of the display device, is detected, and thus, the VID value of the EPI data signal is raised to output the EPI data signal. That is, the timing controller 130 raises the VID value of the EPI data signal to VID2 and outputs the EPI data signal.

According to an embodiment, after the VID value of the EPI data signal is raised, the timing controller 130 may output the EPI data signal having the raised VID value for a certain time. According to another embodiment, after the VID value of the EPI data signal is raised, when a detection signal having the second level is input again, the timing controller 130 may restore the VID value of the EPI data signal to a preset value. According to still another embodiment, after the VID value of the EPI data signal is raised, the timing controller 130 may continuously output the EPI data signal having the raised VID value.

As described above, when the VID value of the EPI data signal is raised, it is possible to prevent a lock fail from occurring by an external electromagnetic wave signal.

Figure 23:
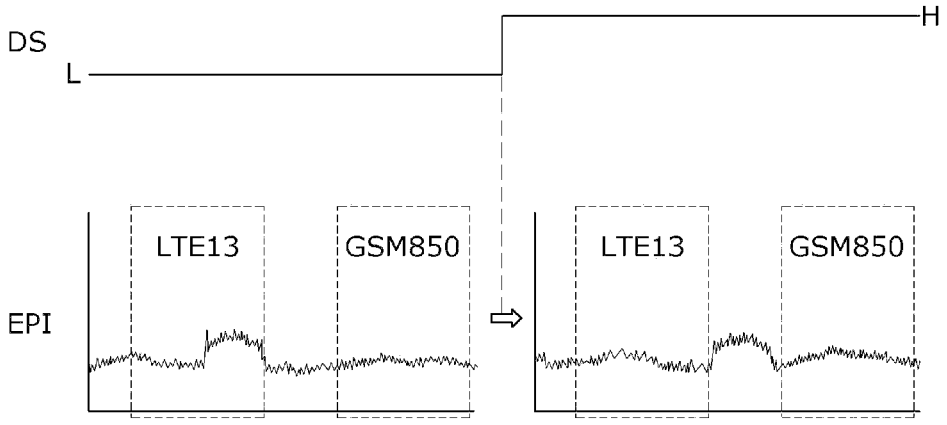
FIG. 23 is a diagram for describing a process of shifting a frequency band of an EPI data signal according to an embodiment of the present disclosure.

FIG. 23 is a diagram for describing a process of shifting a frequency band of an EPI data signal according to an embodiment of the present disclosure.

When a detection signal having a voltage magnitude of a first level is received from the detection signal output unit 300, a timing controller 130 shifts a frequency band of an EPI data signal to a frequency band adjacent to the frequency band of the EPI data signal among a plurality of preset frequency bands and outputs the EPI data signal.

Referring to FIG. 23, when a detection signal DS is output at a second level, the EPI data signal is output in a frequency band of LTE13. When the detection signal is output at the second level, an electromagnetic wave signal, which is enough to interfere with an output of a display device, is not detected, and thus, the EPI data signal is output in the frequency band of LTE13, which is a preset frequency band.

However, when the detection signal DS is output at a first level, the timing controller 130 converts a frequency band of the EPI data signal into an adjacent frequency band and outputs the EPI data signal. When the detection signal is output at the first level, an electromagnetic wave signal, which is enough to interfere with the output of the display device, is detected, and thus, the frequency band of the EPI data signal is shifted to an adjacent frequency band in order to block interference caused by surrounding electromagnetic wave signals.

According to an embodiment, after the frequency band of the EPI data signal is shifted, the timing controller 130 may output the EPI data signal in the shifted frequency band for a certain time. In another embodiment, after the frequency band of the EPI data signal is shifted, when a detection signal having the second level is input again, the timing controller 130 may restore the frequency band of the EPI data signal to a previous frequency band. According to still another embodiment, after the frequency band of the EPI data signal is shifted, the timing controller 130 may continuously output the EPI data signal in the shifted frequency band.

As described above, when the frequency band of the EPI data signal is shifted, it is possible to prevent a lock fail from occurring by an external electromagnetic wave signal.

Figure 24:
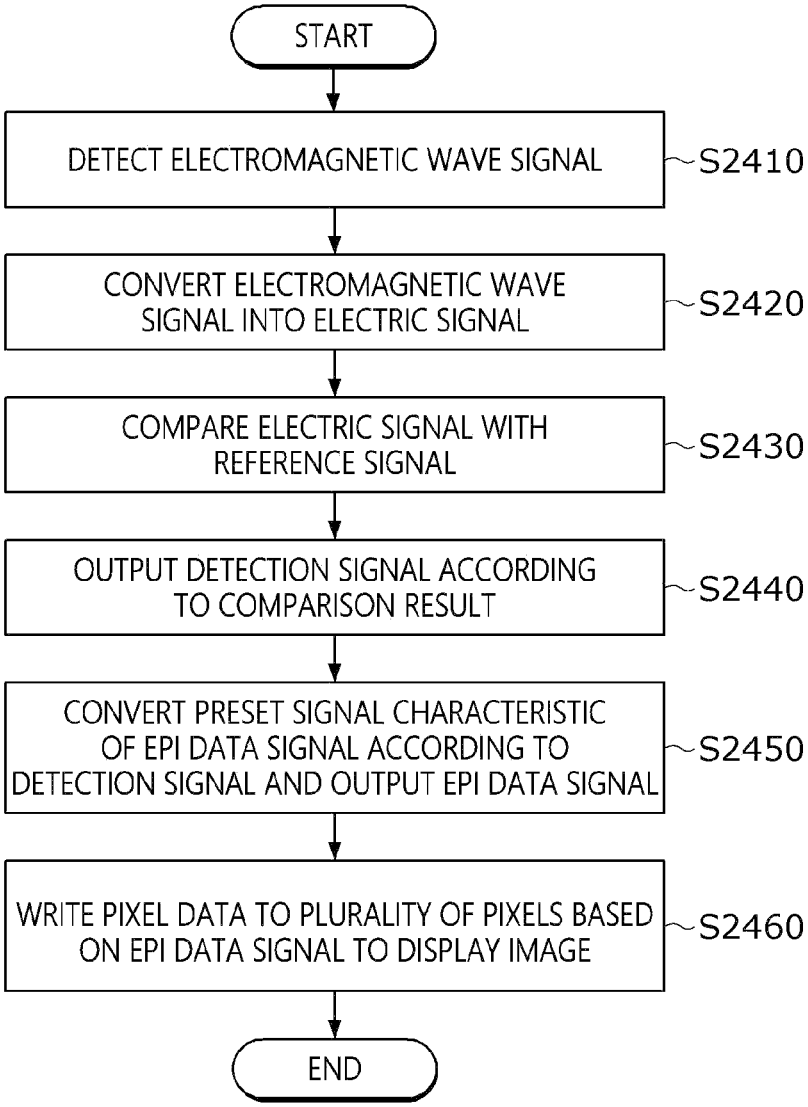
FIG. 24 is a flowchart of a display device driving method according to an embodiment of the present disclosure.

FIG. 24 is a flowchart of a display device driving method according to an embodiment of the present disclosure.

The display device driving method according to the embodiment of the present disclosure may be implemented using the display device according to the embodiment of the present disclosure.

Referring to FIG. 24, the display device driving method according to the embodiment of the present disclosure may include operations S2410 to S2460.

First, a wireless signal detection unit detects a surrounding electromagnetic wave signal (S2410).

Next, the wireless signal detection unit converts the detected electromagnetic wave signal into an electric signal (S2420).

Then, a detection signal output unit compares the electric signal input from the wireless signal detection unit with a preset reference signal (S2430).

Subsequently, the detection signal output unit outputs a detection signal according to the comparison result (S2440).

Next, a timing controller generates an EPI data signal according to an EPI protocol, converts a preset signal characteristic of the EPI data signal according to the detection signal and outputs the EPI data signal (S2450).

Then, a display panel driver writes pixel data of an input image onto a plurality of pixels based on the EPI data signal input from the timing controller, and a display panel displays an image using the plurality of pixels (S2460).

According to embodiments, it is possible to provide a display device which is robust against an electromagnetic wave signal around the display device.

It is possible to provide a stable image by changing a signal characteristic of an EPI data signal adaptively to a usage environment of a display device.

The various and advantageous advantages and effects of the present disclosure are not limited to the above description and may be more easily understood in the course of describing specific embodiments of the present disclosure.

While the present disclosure has been mainly described with reference to the embodiments, it should be understood that the present disclosure is not limited to the disclosed embodiments and that various modifications and applications may be devised by those skilled in the art without departing from the gist of the present disclosure. For example, each component specifically shown in the embodiment may be modified and implemented. Differences related to these modifications and applications should be construed as being within the scope of the present disclosure defined by the appended claims.

What is claimed is:

1. A display device comprising:

a display panel configured to display an image using a plurality of pixels;

a timing controller configured to generate an embedded clock point-to-point interface (EPI) data signal according to an EPI protocol;

a display panel driver configured to write pixel data of an input image onto the plurality of pixels based on the EPI data signal;

a wireless signal detection unit configured to detect an electromagnetic wave signal surrounding the display device and convert the detected electromagnetic wave signal into an electric signal; and a detection signal output unit configured to compare the electric signal with a reference signal and output a detection signal according to a comparison result, wherein the timing controller converts a preset signal characteristic of the EPI data signal according to the detection signal and outputs the EPI data signal.

2. The display device of claim 1, wherein when a voltage magnitude of the electric signal is larger than a voltage magnitude of the reference signal, the detection signal output unit outputs the detection signal having a first level, and wherein when the voltage magnitude of the electric signal is smaller than the voltage magnitude of the reference signal, the detection signal output unit outputs the detection signal having a second level.

3. The display device of claim 2, wherein when the detection signal having the first level is received from the detection signal output unit, the timing controller raises a voltage identification (VID) value of the EPI data signal.

4. The display device of claim 2, wherein when the detection signal having the first level is received from the detection signal output unit, the timing controller shifts a frequency band of the EPI data signal to a frequency band adjacent to the frequency band of the EPI data signal among a plurality of preset frequency bands.

5. The display device of claim 1, wherein the wireless signal detection unit includes:

an antenna unit configured to detect the electromagnetic wave signal and convert the electromagnetic wave signal into an alternating current (AC) electric signal to output the AC electric signal;

a voltage converting unit configured to amplify and rectify the AC electric signal to convert the AC electric signal into a direct current (DC) electric signal using the converting circuit; and an impedance matching unit configured to reduce reflection due to a difference in impedance between the antenna unit and the voltage converting unit (ADC) through using an impedance matching circuit.

6. The display device of claim 5, wherein the antenna unit includes at least one of a spiral antenna, a meander antenna, or a mechanical structure antenna using a structure constituting the display device.

7. The display device of claim 6, wherein the mechanical structure antenna is electrically connected to a connection terminal of the impedance matching circuit printed on a printed circuit board, and the connection terminal is disposed to be spaced apart from a ground terminal of the printed circuit board.

8. The display device of claim 5, wherein the impedance matching unit is electrically connected to the antenna unit through one or more connection terminals, and the impedance matching unit includes one or more impedance matching circuits corresponding to the one or more connection terminals.

9. The display device of claim 5, wherein the voltage converting unit includes at least one of a first conversion circuit configured to amplify the AC electric signal, a second conversion circuit configured to rectify the AC electric signal, or a third conversion circuit configured to amplify and rectify the AC electric signal according to an output condition of the antenna unit.

10. The display device of claim 9, wherein in a case that the antenna unit is designed to output the AC electric signal in a range that is less than a first voltage value, in the converting circuit, the first conversion circuit and the third conversion circuit which are sequentially connected, the antenna unit is connected to one end of the first conversion circuit, and the detection signal output unit is connected to one end of the third conversion circuit.

11. The display device of claim 9, wherein in a case that the antenna unit is designed to output the AC electric signal in a range that is greater than or equal to a first voltage value, the voltage converting unit includes the third conversion circuit connected between the antenna unit and the detection signal output unit.

12. The display device of claim 9, wherein in a case that the antenna unit is designed to output the AC electric signal in a range greater than or equal to a second voltage value, the voltage converting unit includes:

a first converting circuit including the first conversion circuit and the second conversion circuit which are sequentially connected, the detection signal output unit connected to one end of the second conversion circuit;

a second converting circuit including the third conversion circuit connected between the antenna unit and the detection signal output unit; and a switching element disposed between the first converting circuit and the second converting circuit and configured to control the voltage converting unit (ADC) to provide an output of one of the first converting circuit and the second converting circuit to the detection signal output unit.

13. The display device of claim 12, wherein the switching element is turned on or off based on an output of the second converting circuit, when a voltage amplitude of the AC electric signal is greater than or equal to the second voltage value and less than a first voltage value, the switching element controls the voltage converting unit to provide an output of the first converting circuit to the detection signal output unit, when the voltage amplitude of the AC electric signal is greater than or equal to the first voltage value, the switching element controls the voltage converting unit to provide an output of the second converting circuit to the detection signal output unit.

14. The display device of claim 9, wherein the first conversion circuit includes an operational amplifier element or a bipolar junction transistor.

15. The display device of claim 1, wherein the detection signal output unit includes:

a comparison unit configured to compare the electric signal with the reference signal and output a comparison voltage; and a switching unit configured to generate the detection signal according to the comparison voltage.

16. The display device of claim 15, wherein comparison unit includes a comparator element and a plurality of resistor elements connected to one end of the comparator element, the reference signal is determined by a resistance value setting of the plurality of resistor elements.

17. A method for driving a display device, comprising:

detecting an electromagnetic wave signal surrounding the display device;

converting the detected electromagnetic wave signal into an electric signal;

comparing the electric signal with a reference signal;

outputting a detection signal according to a comparison result;

converting a preset signal characteristic of an embedded clock point-to-point interface (EPI) data signal, which is generated according to an EPI protocol, based on the detection signal, and outputting the EPI data signal; and writing pixel data of an input image onto a plurality of pixels based on the EPI data signal and displaying an image using the plurality of pixels.

18. The method of claim 17, wherein the display device includes a wireless signal detection unit, and the wireless signal detection unit includes:

an antenna unit configured to detect the electromagnetic wave signal and convert the electromagnetic wave signal into an alternating current (AC) electric signal to output the AC electric signal;

a voltage converting unit configured to amplify and rectify the AC electric signal to convert the AC electric signal into a direct current (DC) electric signal using the converting circuit; and an impedance matching unit configured to reduce reflection due to a difference in impedance between the antenna unit and the voltage converting unit (ADC) through using an impedance matching circuit.

19. The method of claim 18, wherein the voltage converting unit includes at least one of a first conversion circuit configured to amplify the AC electric signal, a second conversion circuit configured to rectify the AC electric signal, or a third conversion circuit configured to amplify and rectify the AC electric signal according to an output condition of the antenna unit.

20. The method of claim 19, wherein in a case that the antenna unit is designed to output the AC electric signal in a range greater than or equal to a second voltage value, the voltage converting unit includes:

a first converting circuit including the first conversion circuit and the second conversion circuit which are sequentially connected, the detection signal output unit connected to one end of the second conversion circuit;

a second converting circuit including the third conversion circuit connected between the antenna unit and the detection signal output unit; and a switching element disposed between the first converting circuit and the second converting circuit and configured to control the voltage converting unit (ADC) to provide an output of one of the first converting circuit and the second converting circuit to the detection signal output unit.

* * * * *